US008647190B2

(12) United States Patent
Okada

(10) Patent No.: US 8,647,190 B2
(45) Date of Patent: Feb. 11, 2014

(54) DATA CONVERTER FOR GAMING MACHINE AND CREDIT MANAGEMENT SYSTEM

(75) Inventor: Kazuo Okada, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1964 days.

(21) Appl. No.: 11/561,916

(22) Filed: Nov. 21, 2006

(65) Prior Publication Data

US 2007/0213122 A1 Sep. 13, 2007

(30) Foreign Application Priority Data

Nov. 22, 2005 (JP) ..... 2005-337506

(51) Int. Cl.
*A63F 9/24* (2006.01)

(52) U.S. Cl.
USPC ..... 463/25; 463/16; 463/20; 463/42; 463/43

(58) Field of Classification Search
USPC ..... 463/25, 20, 29, 1, 16, 42, 43; 902/23, 902/30; 235/380; 705/80, 1.1
See application file for complete search history.

(56) References Cited

U.S. PATENT DOCUMENTS 4,575,622 A * 3/1986 Pellegrini ..... 463/25
4,764,666 A * 8/1988 Bergeron ..... 463/25
5,265,874 A 11/1993 Dickinson et al.
5,290,033 A 3/1994 Bittner et al.
5,371,345 A * 12/1994 LeStrange et al. ..... 235/380
5,429,361 A 7/1995 Raven et al.
5,470,079 A 11/1995 LeStrange et al.
6,048,269 A * 4/2000 Burns et al. ..... 463/25
6,675,152 B1 * 1/2004 Prasad et al. ..... 705/64
6,729,957 B2 5/2004 Burns et al.
6,729,958 B2 5/2004 Burns et al.
6,736,725 B2 5/2004 Burns et al.
6,935,953 B2 * 8/2005 Marcu ..... 463/29
7,147,558 B2 * 12/2006 Giobbi ..... 463/25
7,228,646 B1 * 6/2007 Purcell ..... 34/90
7,328,838 B2 * 2/2008 Brosnan et al. ..... 235/379
7,828,646 B2 * 11/2010 Franks, Jr. ..... 463/25
2003/0013515 A1 * 1/2003 Rowe et al. ..... 463/25
2003/0013531 A1 * 1/2003 Rowe et al. ..... 463/42
2003/0144965 A1 * 7/2003 Prasad et al. ..... 705/65
2004/0204233 A1 * 10/2004 Saffari et al. ..... 463/25
2005/0282627 A1 * 12/2005 Hedrick et al. ..... 463/25

FOREIGN PATENT DOCUMENTS

WO WO 2005/072330 A2 8/2005

* cited by examiner

*Primary Examiner* — David L Lewis
*Assistant Examiner* — Chase Leichliter
(74) *Attorney, Agent, or Firm* — Lexyoume IP Meister, PLLC.

(57) ABSTRACT

A data converter for gaming machines includes a read out unit that reads out credit information of a gaming machine recorded on a ticket, a data conversion unit that converts the credit information that has been read out into a data format suitable for an electronic medium, and a writing unit that writes the credit information with the converted data format to the electronic medium. A credit management system includes the converter and a data management unit that manages credit information, including credit identifying data and credit data that represents value of credit.

21 Claims, 17 Drawing Sheets

CREDIT CONVERSION PROCESSING

CREDIT CONVERSION PROCESSING

CREDIT RETURN PROCESSING USING CARD

CREDIT RETURN PROCESSING USING CARD

DATA CONVERTER FOR GAMING MACHINE AND CREDIT MANAGEMENT SYSTEM

RELATED APPLICATIONS

This application claims the priority of Japanese Patent Application No. 2005-337506 filed on Nov. 22, 2005, which is incorporated herein by reference.

BACKGROUND OF THE INVENTION

1. Field of the Invention

The present invention relates to a gaming machine that uses credit and particularly relates to a data converter for gaming machines that enables credit issued by a gaming machine to be used in another gaming machine, and a credit information management system provided with a data converter for gaming machines.

2. Description of the Prior Art

Generally in game arcades credit is converted into coins and a gaming machine is used by inserting one of these coins into the gaming machine. It should be noted that here "credit" represents a general purpose exchange value such as a monetary currency. Since coins present problems of convenience when they are used related to their size and weight, gaming machines have been proposed that use tickets instead of coins.

At game arcades that use tickets, tickets are issued instead of coins at a ticket issuing location. With these tickets, code data corresponding to credit is printed on a strip of paper in the form of a barcode or the like. The gaming machine is provided with a reading device that reads the barcode printed on the ticket. When a game player inserts the ticket into the reading device of the gaming machine, the gaming machine executes a game based on the credit recorded in the barcode that has been read (for example, see U.S. Pat. No. 6,729,957).

In addition to the above-mentioned patent document, other patent documents are known as prior art relating to gaming machines that use tickets, including U.S. Pat. Nos. 5,265,874, 5,290,033, 5,429,361, 5,470,079, 6,048,269, 6,729,958 and 6736725.

Generally in game arcades there are gaming machines installed offering various forms of games such as slot machines, pachinko machines and the like. These gaming machines are not only the gaming machines having different forms of games, but also include gaming machines offering the same form of game which is varied and not provided with the same game mechanism due to such factors as having different gaming machine manufacturers and manufacture dates. For this reason, even within the same game arcades, not all the gaming machines may be capable of using tickets and there may be gaming machines installed that do not support tickets. Consequently, gaming machines that do not have installed a mechanism capable of using tickets are not able to carry out a game using tickets.

FIG. 17 includes diagrams for describing a gaming machine that uses tickets. FIG. 17A illustrates a gaming machine that supports coins, and a gaming machine 3 executes a game upon insertion of a coin 13. FIG. 17B illustrates a ticket-compatible gaming machine that supports tickets. A ticket-compatible gaming machine 3*p* executes a game using tickets instead of coins by having a ticket reading device read credit information recorded on a ticket 11.

FIG. 17C illustrates a ticket-incompatible gaming machine that does not support tickets. A ticket-incompatible gaming machine 3*a* cannot read the credit information recorded on tickets and therefore to carry out a game using a ticket, the credit recorded on a ticket 11 must be converted at a conversion facility such as a counter provided in the game arcades to a medium such as the coin 13 or the like, which can be used on the gaming machine the game player is attempting to use, then the ticket-incompatible gaming machine 3*a* is used by using the converted coin 13.

For this reason, the game player cannot enjoy the convenience of tickets.

This problem can be somewhat addressed by installing a ticket reading device in the ticket-incompatible gaming machine that does not support tickets, but in this case a ticket reading device must be installed in each of the gaming machines, which presents another problem of having to install a ticket reading device each time a gaming machine is replaced.

Furthermore, it is necessary to protect against illicit conversion of credit information when converting credit information. With the above-described configuration in which credit information conversion is carried out by simply installing a ticket reading device in the ticket-incompatible gaming machine, there is a problem in that it is difficult to protect against illicit conversion of credit information.

SUMMARY OF THE INVENTION

The present invention addresses these issues and it is an object thereof to carry out a game with an equivalent convenience as that afforded by tickets in a ticket-incompatible gaming machine that does not support tickets and it is an object to protect against illicit conversion of credit information.

That is, the present invention is provided with the configuration mentioned below, and by transferring credit information of credit that has been recorded on a ticket to an electronic medium, can carry out a game in a ticket-incompatible gaming machine that does not support tickets and without losing any of the same convenience of tickets. Furthermore, the present invention prevents illicit conversion of credit by specifying the credit information.

The present invention includes a form of a data converter for gaming machines that converts credit information from the ticket to the electronic medium and a form of a credit management system provided with a data management unit that manages credit information that has undergone data conversion by the data converter for gaming machines.

In the form of the data converter for gaming machines, the data converter for gaming machines is provided with a function of transferring credit information recorded on the ticket to the electronic medium, and is provided with a read out unit that reads out gaming machine credit information recorded on the ticket, a data conversion unit that performs data conversion on the credit information that has been read out to a data format suitable for an electronic medium, and a writing unit that writes to the electronic medium the credit information whose data format has been converted.

Credit represents a general purpose exchange value such as a monetary currency, and here mainly represents an exchange value by which conversion can be achieved so as to enjoy usage of the gaming machine. With credit, the gaming machine can be used equivalent to a value afforded by the credit and can also be used in exchange for other products or for the enjoyment of services.

Credit information in the present invention is provided with credit data representing the value of the credit and credit identifying data that specifies the credit. In the present invention, the actual credit is specified by the credit identifying data and in addition to carrying out specification of the credit to be converted in data conversion from the ticket to a recording medium such as a card using the credit identifying data, can also be used to specify credit and manage the validity of credit usage using the credit identifying data when the credit recorded on the recording medium is used.

With the data converter for gaming machines of the present invention, the recording medium onto which the credit information is recorded is in one aspect a ticket and in another aspect is a recording medium other than the ticket or even if a ticket, it has different dimensions such that problems originating in different forms of the recording medium are eliminated and problems originating in different data forms of credit information recorded on the recording medium are eliminated.

The read out unit provided in the data converter for gaming machines reads out the credit information recorded on the ticket. For example, when the credit information is recorded on the ticket in the form of a barcode, the read out unit can be configured as a barcode reader.

The data conversion unit provided in the data converter for gaming machines converts the credit information that has been read out by the read out unit to a data format or data specification that can be recorded on the recording medium to which conversion will be performed. The data format may be a code format such as an ASCII code for example and the data specification may be a data structure of a bit value or an information array order representing credit information for example. It should be noted that this is one example of the data format and which data format to use will vary according to the gaming machine to be used.

The data converter for gaming machines has a conversion program for carrying out conversions between the data format or data specification of the credit information recorded on the ticket and the data format or data specification suitable for the gaming machine to which converted-data is to be sent, and carries out data conversion according to this conversion program.

Accordingly, with the data conversion unit, the hardware configuration for carrying out data conversion may be achieved by such components as a storage unit that stores the conversion program, a storage unit that temporarily stores data of credit information read from a reading unit, data during conversion processing, and converted data, and a signal processing unit such as a CPU for carrying out data conversion according to the conversion program.

Furthermore, the data conversion unit prevents illicit conversion of credit by specifying the credit based on the credit information.

The writing unit is provided with a function for writing to the electronic medium the credit information whose data format has been converted and provided with a configuration corresponding to the electronic medium. For example, it can be configured to have a magnetic recording head when the electronic medium is a magnetic recording medium and configured to have a ROM writer when the electronic medium is a semiconductor memory.

In the present invention, a card can be used as a support structure that supports the electronic medium. With the data converter for gaming machines, when the credit information recorded on the ticket is read out and the credit information converted to the electronic medium mounted in the card is recorded, the specification of the card can use card identifying data that is set for each card.

When using the card, in addition to the form of recording the credit information and the card identifying data on the card, there is a second form that can be used, namely recording only the card identifying data on the card and not recording the credit information.

With the first form in which the credit information and the card identifying data is recorded on the card, when card identifying data that specifies the card is already recorded on the card, the writing unit writes only the credit information to the electronic medium mounted in the card.

Furthermore, when card identifying data that specifies the card is not set such as for an on-demand card, in addition to the credit information, card identifying data that specifies that card is written to the electronic medium mounted in the card.

With the form in which the credit information and card identifying data is recorded on the card, the credit information can be managed on the card side and a user can manage credit using that card as an independent unit, so that supposing credit is illicitly converted, this can be restricted to only the credit recorded on that card.

Furthermore, in addition to specifying the card itself using the card identifying data, by specifying the credit using the credit identifying data contained in the credit information, it is possible to prevent illicit conversion of credit.

With the second form in which only the card identifying data is recorded on the card, when card identifying data that specifies the card is already recorded on the card such as member's card, the writing unit writes only the credit identifying data to the electronic medium mounted in the card.

Furthermore, when card identifying data that specifies the card is not set such as for an on-demand card, credit identifying data and card identifying data that specifies that card is written to the electronic medium mounted in the card.

In a form in which credit information is not recorded to a card and only card identifying data is recorded, the credit information can be managed comprehensively by the data management side that manages data.

Furthermore, in addition to specifying the card itself using the card identifying data, by specifying the credit using the credit identifying data contained in the credit information, it is possible to prevent illicit conversion of credit.

When card identifying data that specifies the card is not set such as for an on-demand card, it is necessary to generate card identifying data that specifies a card to be written to at a time of data conversion.

In addition to a form in which generation is carried out on the side of the data converter for gaming machines, generation of the card identifying data may be set to a form in which it is carried out on the data management unit side.

In the form in which generation is carried out on the side of the data converter for gaming machines, the writing unit generates card identifying data that specifies the card and writes the generated card identifying data to an electronic medium mounted in a card. Furthermore, the data converter for gaming machines is configured to be provided with a transceiver unit for sending and receiving data to and from the data management unit, and the transceiver unit sends to the data management unit the card identifying data and the credit identifying data.

The data management unit specifies the card using the card identifying data that has been sent and specifies the credit using the credit identifying data, thereby managing credit and monitoring for illicit usage. Furthermore, in the form in which generation of the card identifying data is carried out by the data management unit, the writing unit obtains the card identifying data generated by the data management unit and writes to the electronic medium mounted in the card the card identifying data obtained from the data management unit.

The data management unit specifies the card using the card identifying data that has been generated and specifies the credit using the credit identifying data, thereby managing credit and monitoring for illicit usage.

Furthermore, the data converter for gaming machines of the present invention can be configured to convert for use as a ticket the credit information recorded in the electronic medium mounted in the card and enable recording to tickets.

The data converter for gaming machines is provided with a read out unit that reads out credit information of a gaming machine recorded on electronic medium, a data conversion unit that carries out data conversion on the credit information that has been read out to make it into a data format suitable for tickets, and a writing unit that writes the credit information that has been converted to the data format suitable for the ticket. Here, the credit information recorded on the ticket is recorded in a data format of a barcode and can be printed on a ticket or stored on magnetic medium for example.

Furthermore, the credit identifying data of the present invention can include time limit data that determines a valid period of the credit identifying data. The data conversion unit sets time limit data at a time of data conversion and establishes a time limit in which the validity of the credit specified by the credit identifying data is guaranteed.

The time limit data may take various forms such as a form of time data representing a finish time at which validity finishes, time data representing a start time and finish time of validity, time data representing a start time of validity, and time duration data representing a time duration of validity.

The data management unit or the gaming machine manages the usage time of the credit based on the time limit data and restricts usage of credit that has exceeded a valid period. By applying time restrictions on the validity of credit using this time limit data, the opportunities for illicit usage of credit can be reduced.

It should be noted that the electronic medium on which converted credit information is recorded may be a semiconductor recording medium mounted in an IC card or a magnetic recording medium mounted in a magnetic card.

Furthermore, a form of the credit management system of the present invention is provided with a data converter for gaming machines that performs data conversion and transfers credit information of a gaming machine from a ticket to an electronic medium, and a data management unit that manages credit information.

Here the data converter for gaming machines can be configured in the same form mentioned above and moreover the credit information is provided with credit identifying data that specifies credit and credit data that represents a value of the credit.

The data management unit is installed within game arcades along with a plurality of gaming machines and the data converter for gaming machines, and the gaming machines and the data converter for gaming machines are connected by a cabled or wireless network. The data management unit manages credit by specifying credit based on credit identifying data contained in the respective credit information. It should be noted that a single data converter for gaming machines may be installed within the game arcades or a plurality of these may be installed.

For the electronic medium mounted in the cards, the data converter for gaming machines writes the credit information to cards having card identifying data that specifies the card, and writes credit information and card identifying data that specifies the card to cards in which there is no card identifying data that specifies the card. The data management unit specifies the card based on the card identifying data and carries out management by specifying the credit based on the credit identifying data.

As described above, the data management unit specifies the card using the card identifying data that has been sent and specifies the credit using the credit identifying data, thereby managing credit and monitoring for illicit usage.

The data converter for gaming machines sends the credit identifying data of the credit to the data management unit during data conversion of the credit information. The data management unit manages data conversion of the credit using the credit identifying data received from the data converter for gaming machines.

Furthermore, the data converter for gaming machines sends the credit information of the credit to the data management unit during data conversion of the credit information. The data management unit manages data conversion of the credit and the credit data that has undergone data conversion according to the credit information received from the data converter for gaming machines.

When time limit data that determines the valid period of the credit identifying data is included in the credit identifying data, the data converter for gaming machines sets the time limit data at the time of data conversion. The data management unit determines validity of credit based on the valid period set in the time limit data.

DESCRIPTION OF THE PREFERRED EMBODIMENTS

Hereinafter, embodiments of the present invention are described in detail with reference to the accompanying drawings.

Figure 1A:
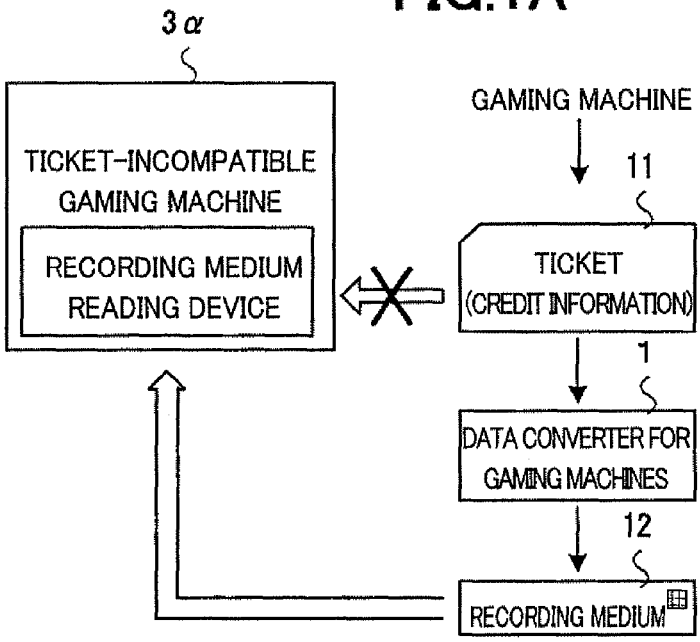
FIGS. 1A and 1B are diagrams for describing forms of usage of a data converter for gaming machines according to the present invention.
Figure 1B:
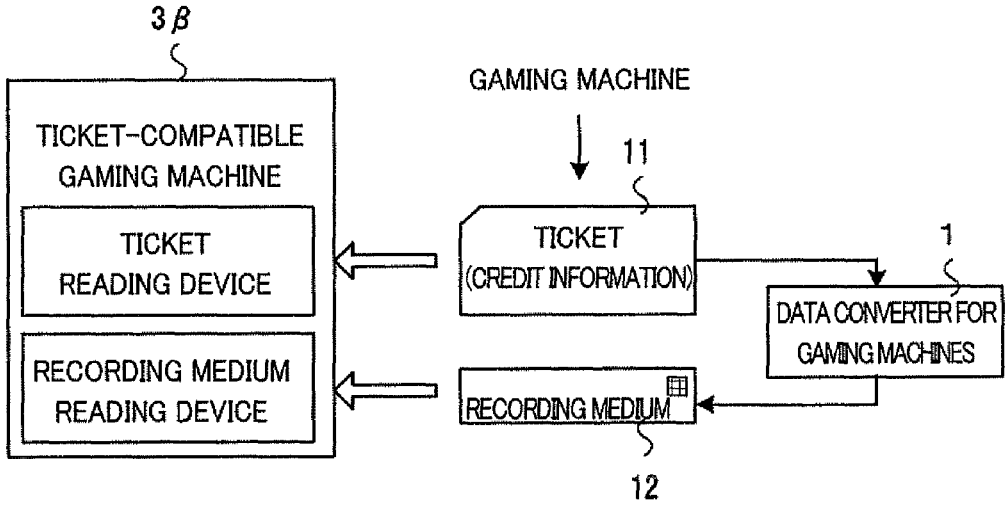
Figure 2:
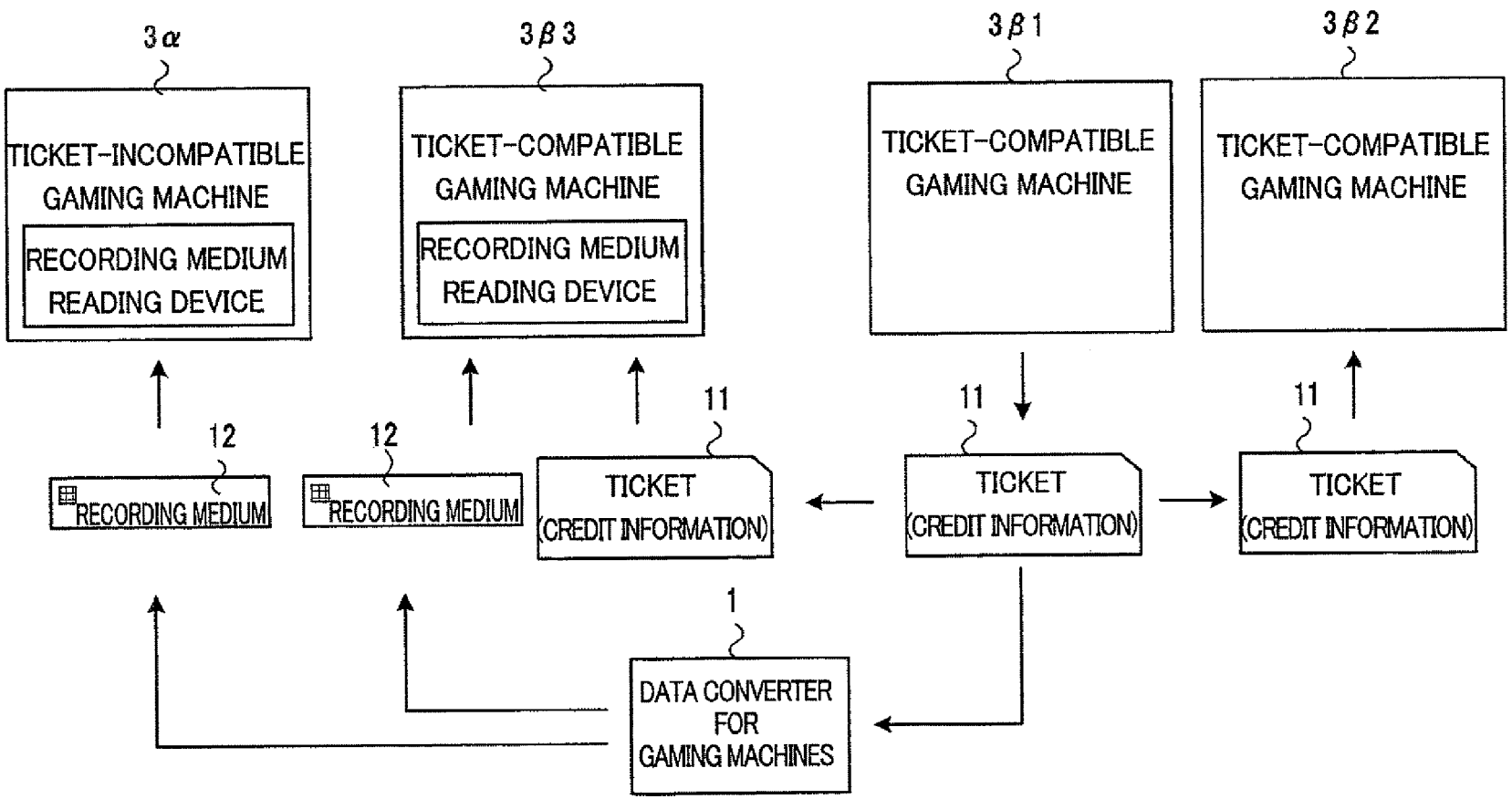
FIG. 2 is a diagram for describing forms of usage of a data converter for gaming machines according to the present invention.

FIGS. 1A and 1B, and FIG. 2 are diagrams for describing forms of usage of a data converter for gaming machines according to the present invention.

FIG. 1A illustrates a case of a ticket-incompatible gaming machine in which tickets cannot be used.

At the game arcade, a user not only holds a ticket 11 on which is recorded credit information obtained at another gaming machine, but also obtains credit at a counter provided by the game arcade, and records that credit as credit information on the ticket 11.

The user cannot use the ticket-incompatible gaming machine 3α using the ticket 11. This is because the ticket-incompatible gaming machine 3α cannot read the credit information recorded on the ticket.

Accordingly, in the present invention, a data converter 1 for gaming machines is used to transfer the credit information recorded on the ticket 11 to a recording medium 12, and the credit information recorded on the recording medium 12 is read by a recording medium reading device provided in the ticket-incompatible gaming machine 3α. By performing data conversion on the credit information and transferring the credit information from the ticket to an electronic medium, the ticket-incompatible gaming machine 3α is capable of a game that uses credit even though it is a ticket-incompatible gaming machine.

The data converter for gaming machines of the present invention can be applied not only to the above-described ticket-incompatible gaming machines but also to ticket-compatible gaming machines on which a game can be carried out using tickets.

FIG. 1B illustrates a case of a ticket-compatible gaming machine in which tickets can be used.

In addition to using the ticket-compatible gaming machine 3β by using the ticket 11, the user can have the credit information recorded on the ticket 11 undergo data conversion at the data converter 1 for gaming machines and transferred to the recording medium 12, and using this recording medium 12 enables the player to use the ticket-compatible gaming machine 3β.

In the form of usage shown in FIG. 1B, in addition to the ticket 11 being used as it is to use the ticket-compatible gaming machine 3β, the recording medium 12 that has undergone data conversion by the data converter 1 for gaming machines is used to use the ticket-compatible gaming machine 3β.

By setting a form such that ticket-compatible gaming machines can also use the recording medium 12, support for both a usage form based on tickets and a usage form based on recording media becomes possible, thereby enabling enhanced general purpose capabilities in usage forms for gaming machines that use credit.

FIG. 2 illustrates a usage form in which, using credit obtained from a ticket-compatible gaming machine 3β, the ticket-incompatible gaming machine 3α or another ticket-compatible gaming machine 3β is used.

Credit obtained from a ticket-compatible gaming machine 3β1 is recorded on the ticket 11 in a recording form such as a barcode for example. The recording of credit to the ticket 11 is carried out using a form of credit information containing credit data representing the actual credit and credit identifying data that is associated with that credit and specifies the credit.

When using a different ticket-compatible gaming machine 3β2, the ticket 11 can be used as it is.

And when using the ticket-incompatible gaming machine 3α, credit information of the ticket 11 that has undergone data conversion at the data converter 1 for gaming machines is transferred to the recording medium 12 and the game is carried out on the ticket-incompatible gaming machine 3α using the recording medium 12.

Furthermore, when using the ticket-compatible gaming machine 3β3, which is capable of using both tickets and recording media, in addition to using the ticket 11 as it is, it is possible that credit information of the ticket 11 that has undergone data conversion at the data converter 1 for gaming machines is transferred to the recording medium 12 and the game can be carried out using the recording medium 12.

Thus, by using the data converter for gaming machines, it is possible to use various gaming machines having different usage forms of credit, thereby enabling enhanced general purpose properties of usage of gaming machines.

Furthermore, by adding credit data representing the actual credit and credit identifying data, which specifies the credit, to the credit information that passes between the gaming machines, and between the gaming machines and the data converter for gaming machines, it is possible to easily identify and specify credit using the credit identifying data in situations where illicit usage of credit is prone to occur such as during data conversion and at the time of usage of credit, thereby enabling illicit usage of credit to be suppressed.

Figure 3:
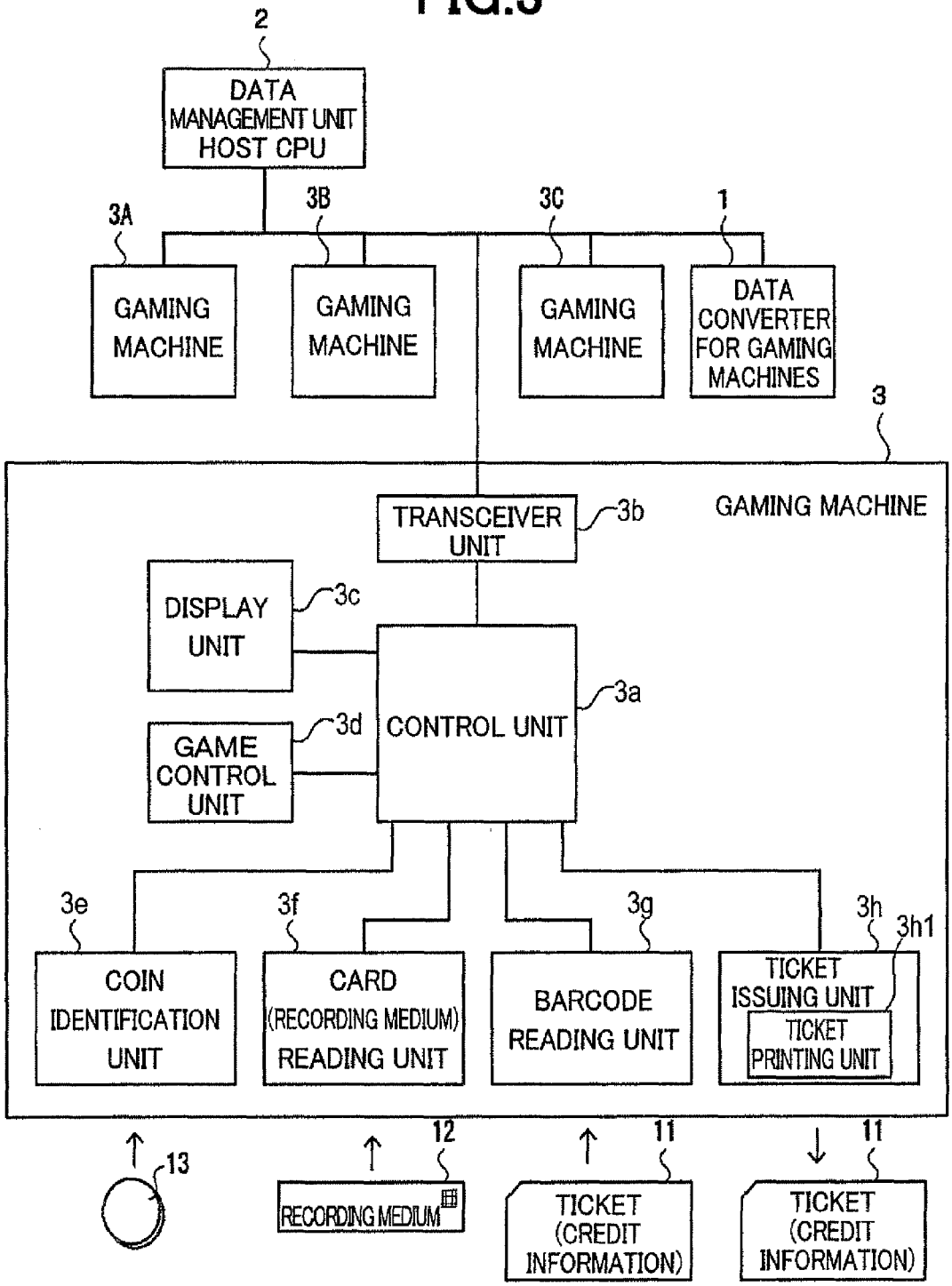
FIG. 3 is a diagram for describing a configuration provided with gaming machines using tickets and game arcades.

FIG. 3 is a diagram for describing a configuration in which gaming machines using credit and game arcades are provided. In FIG. 3, a plurality of gaming machine 3 and 3A to 3C, a data converter 1 for gaming machines, and a data management unit 2 are provided in the game arcade, and these are connected by cables or wirelessly. It should be noted that the data management unit 2 is provided with a host CPU and controls various actions.

The gaming machine 3 is provided with a display unit 3*c* configured as part of the gaming machine itself and a game control unit 3*d* for controlling functions of the gaming machine. This configuration can be configured using an ordinary gaming machine and therefore description is omitted here.

The gaming machine 3 is provided with a coin identification unit 3*e*, a card (recording medium) reading unit 3*f*, a barcode reading unit 3*g*, and a control unit 3*a* as a configuration for enabling operation of the gaming machine based on credit.

The coin identification unit 3*e* identifies the coin 13 that has been inserted. The control unit 3*a* controls the game control unit 3*d* based on a numerical amount of credit assigned to the coin 13 to execute the gaming machine and displays this on the display unit 3*c*. This operation is the same as an ordinary gaming machine.

The barcode reading unit 3*g* reads credit information recorded on the ticket 11 and sends the credit information that it has read to the control unit 3*a*. Based on the credit information that has been read by the barcode reading unit 3*g*, the control unit 3*a* determines the legitimacy of the credit as to whether or not it is legitimate or illicit, and when the credit is recognized as legitimate, the control unit controls the game control unit 3*d* based on the numerical amount of credit to execute the gaming machine and performs display on the display unit 3*c*.

The card reading unit 3*f* reads credit information recorded on the recording medium 12 and sends the credit information that it has read to the control unit 3*a*. Based on the credit information that has been read by the card reading unit 3*f*, the control unit 3*a* determines the legitimacy of the credit as to whether or not the credit is legitimate or illicit, and when the credit is recognized as legitimate, the control unit controls the game control unit 3*d* based on the numerical amount of credit to execute the gaming machine.

The gaming machine 3 is also provided with a ticket issuing unit 3*h* that issues credit. The ticket issuing unit 3*h* records on a ticket credit such as credit that has been obtained by executing the gaming machine 3 and credit obtained by the insertion of the coin 13 and issues tickets. The issuing of tickets is carried out by having a ticket printing unit 3*h*1 print a barcode. The barcode is obtained by decoding credit information including the credit to be issued and credit identifying data that specifies the credit.

The gaming machine 3 is provided with a transceiver unit 3*b*, which carries out sending and receiving of data to and from the data management unit 2. Examples of data that is sent and received includes data relating to the status and history of the game on each of the gaming machines 3, coin identification history data that has been identified by the coin identification unit 3*e*, reading history of the reading by the card reading unit 3*f*, reading history of the reading by the barcode reading unit 3*g*, issuing history of the ticket issuing by the ticket issuing unit 3*h*, management data of the control status and control history of the control unit 3*a*, and credit information.

Credit information includes credit data representing the actual credit and credit identifying data that specifies the credit. From the credit data it is possible to determine the numerical amount of credit for example. Furthermore, the credit identifying data uniquely determines each set of credit and therefore it is possible to specify what kind of credit it is.

The data management unit 2 is connected to the gaming machines 3 and 3A to 3C and the data converter 1 for gaming machines, and in addition to managing the operational status of the gaming machines and the data converter for gaming machines, manages the credit handled by the gaming machines and the data converter for gaming machines. Management of the credit can be carried out by specifying the credit based on the credit identifying data contained in the credit information.

Hereinafter, ticket issuance processing is described using FIG. 4 to describe a flow thereof and FIG. 5, which shows a functional block diagram, and credit return processing is described using FIG. 6 to describe a processing flow.

Figure 4:
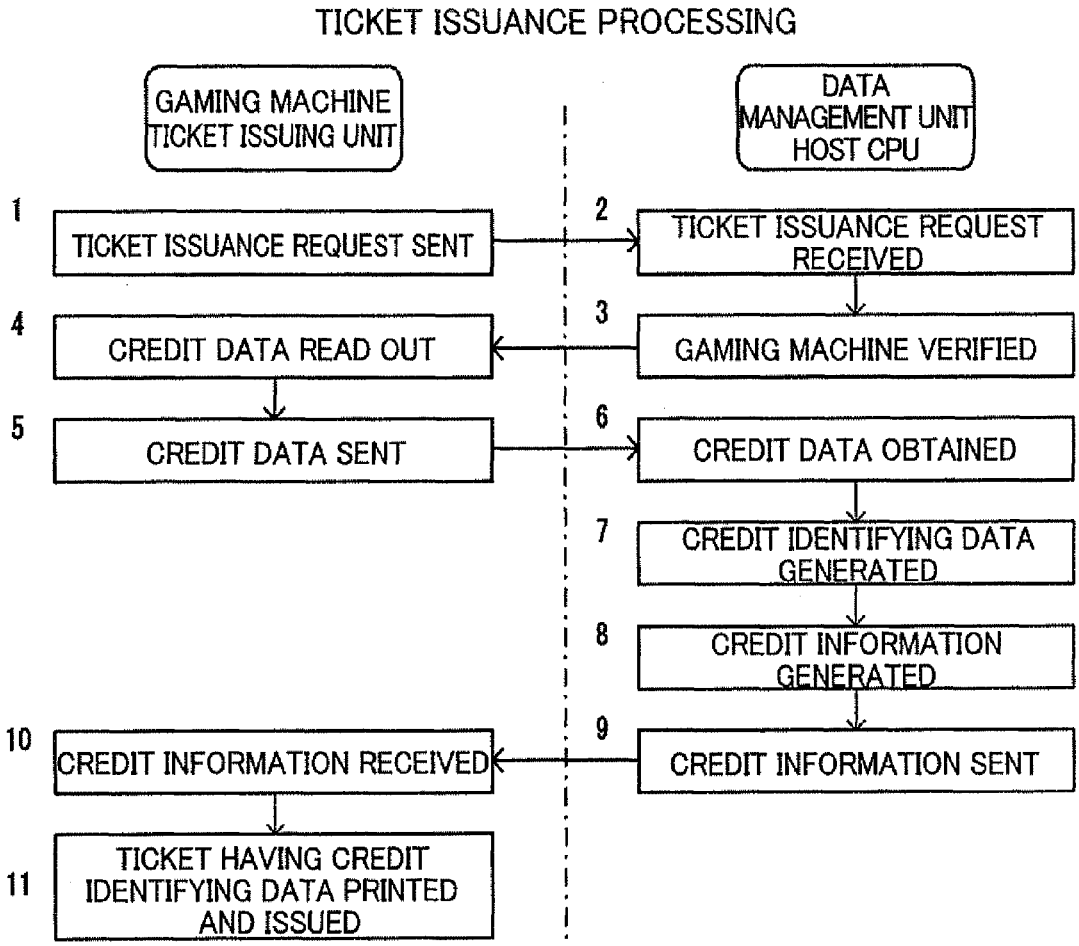
FIG. 4 is a diagram for describing a flow of ticket issuance processing.

FIG. 4 shows a procedural example of ticket issuance processing using the ticket issuing unit 3*h*. FIG. 4 shows a procedure in which the gaming machine makes a request to the data management unit for ticket issuance and a ticket is issued based on verification by the data management unit and credit identifying data generated by the data management unit. It should be noted that numerals in the procedural drawings indicate a procedural order and that in the following description, a symbol "S," which is an abbreviation for "Step," is attached to each of these numerals.

When ticket issuance is requested by the gaming machine, a ticket issuance request is sent (S1) to the data management unit. Upon receiving (S2) the ticket issuance request, the data management unit verifies the gaming machine that has requested issuance and replies (S3) to the gaming machine concerning verification. Verification of the gaming machine can be carried out for example by matching identification data that has been preset in each gaming machine. If verification of the gaming machine fails, the verification failure is displayed at the data management unit for example.

The verified gaming machine reads out (S4) credit data of the requested issuance and sends (S5) to the data management unit the credit data that has been read out.

The data management unit obtains (S6) the credit data sent from the gaming machine and with the obtained credit it generates (S7) credit identifying data that specifies that credit, then generates (S8) credit information matched with the credit data and sends (S9) the generated credit information to the gaming machine.

The gaming machine receives (S10) the credit information sent from the data management unit and prints the credit information on a surface of the ticket using the ticket printing unit. The printing of the credit information is carried out (S11) for example by converting the credit information into a barcode.

Figure 5:
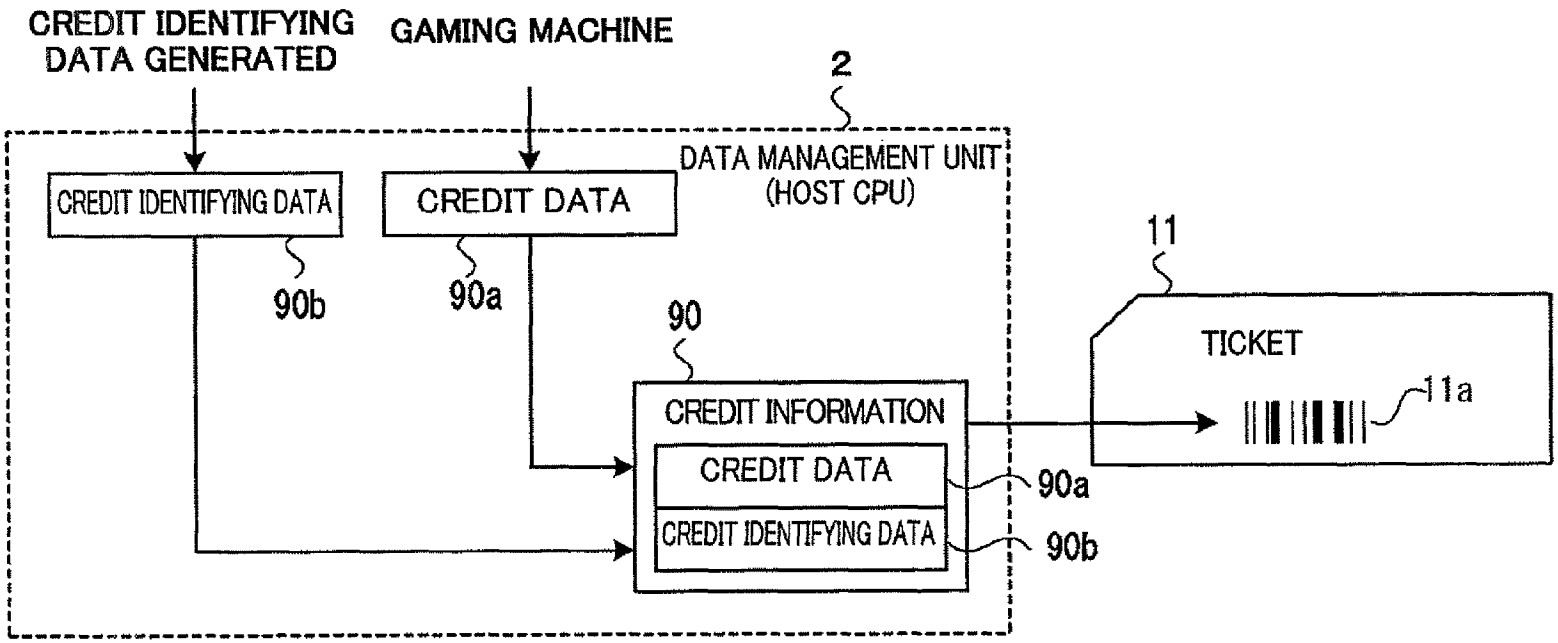
FIG. 5 is a functional block diagram for describing ticket issuance processing.

In FIG. 5, the data management unit 2 generates credit information 90 using credit data 90*a* sent from the gaming machine and generated credit identifying data 90*b*, then prints this in a form of a barcode 11*a* on the ticket 11.

It should be noted that the issuance of tickets is not limited to this procedure and may be performed using another procedure. For example, the gaming machine may determine the issuance of tickets on the gaming machine side without making a request to the data management unit for the verification of ticket issuance and generation of credit identifying data, and may be configured to then generate credit identifying data, generate credit information, and issue tickets based on these. In this case, management of credit on the data management unit side may be achieved by sending credit information generated for the data management unit or credit identifying data only. In the case of sending only the credit identifying data, the data management unit manages only the presence or absence of credit, and the numerical amount of credit can be conducted in a form of management in which management is not conducted.

By using issued tickets to use the gaming machine, the credit can be returned. FIG. 6 shows a procedural example of the gaming machine for returning credit.

Figure 6:
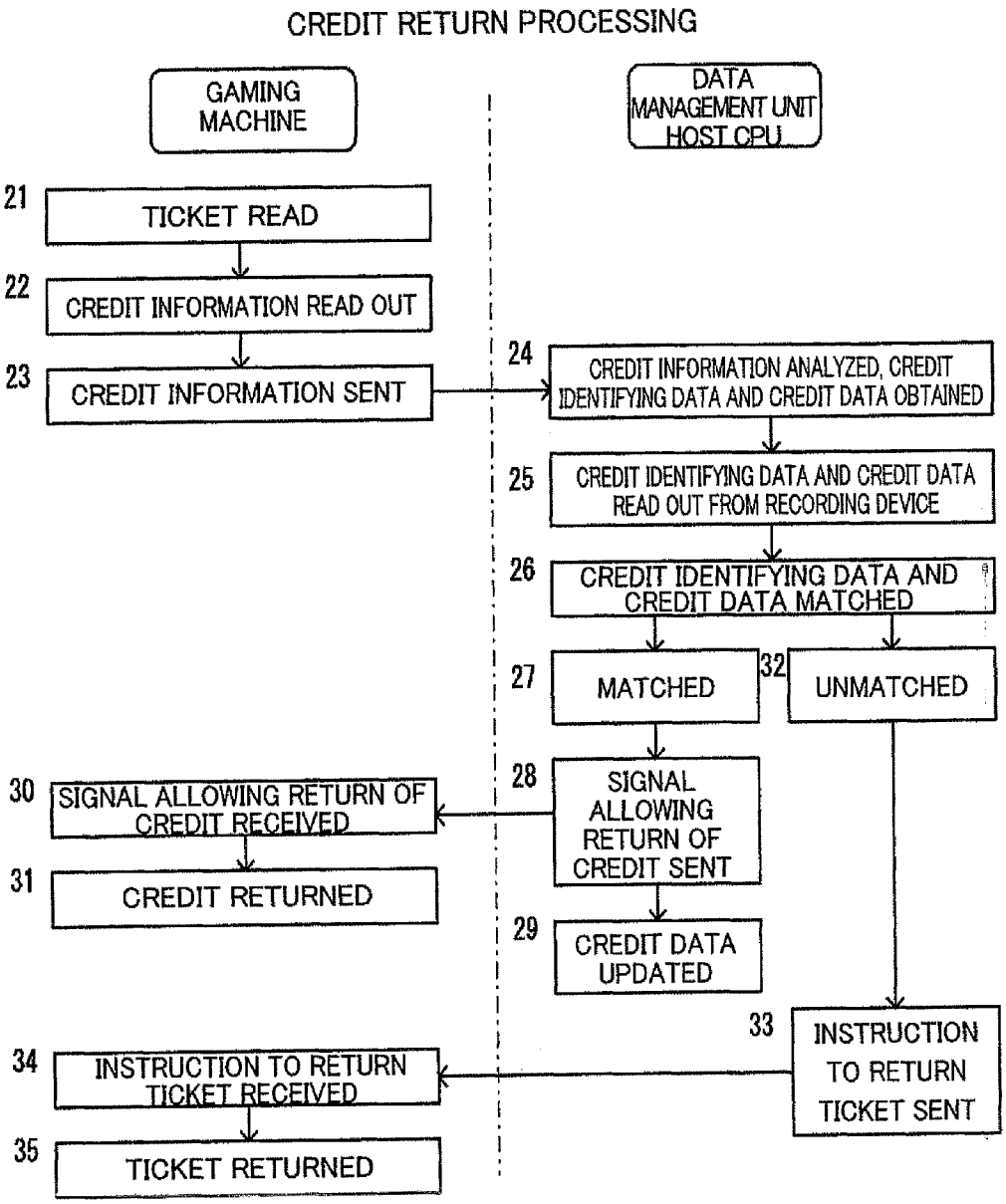
FIG. 6 is a diagram for describing a flow of credit return processing.

In FIG. 6, the gaming machine reads (S21) a barcode that has been printed on a ticket, then reads (S22) the credit information, and sends (S23) to the data management unit the credit information that has been read out.

The data management unit analyzes the credit information to obtain (S24) credit identifying data and credit data. Furthermore, it reads out (S25) credit identifying data and credit data that has been stored in a recording device, then matches the credit identifying data and credit data obtained from the gaming machine with the credit identifying data and the credit data that has been read out from the recording device. It should be noted that verification as to whether credit is legitimate or whether there is a possibility of it being illicit is carried out here using a matching process in regard to the credit identifying data and the credit data, but the legitimacy of the credit may be confirmed (S26) using only the credit identifying data.

When matching has been carried out correctly (S27), a signal is sent (S28) of allowing return of credit to the gaming machine, and when credit data is being managed, the credit data of returned credit is updated (S29).

Upon receiving (S30) a signal allowing return of credit, the gaming machine returns credit (S31). Return of credit can be carried out by executing the gaming machine equivalent to a credit amount determined by the credit data for example. In addition to being collected on the gaming machine side, a ticket whose credit has been returned may be sent back to the user after a return completion process is performed. It should be noted that the returning of credit is not limited to execution on the gaming machine but may be performed by a different process.

When a determination of being unmatched is made (S32) in the matching process of S26, an instruction to return the ticket is sent (S33) to the gaming machine.

Upon receiving (S34) the instruction to return the ticket, the gaming machine returns (S35) the ticket to the user.

Furthermore, in cases where theft or falsification are obvious in the matching of credit identifying data, a process can be carried out of collecting the ticket as it is without returning it.

Figure 7:
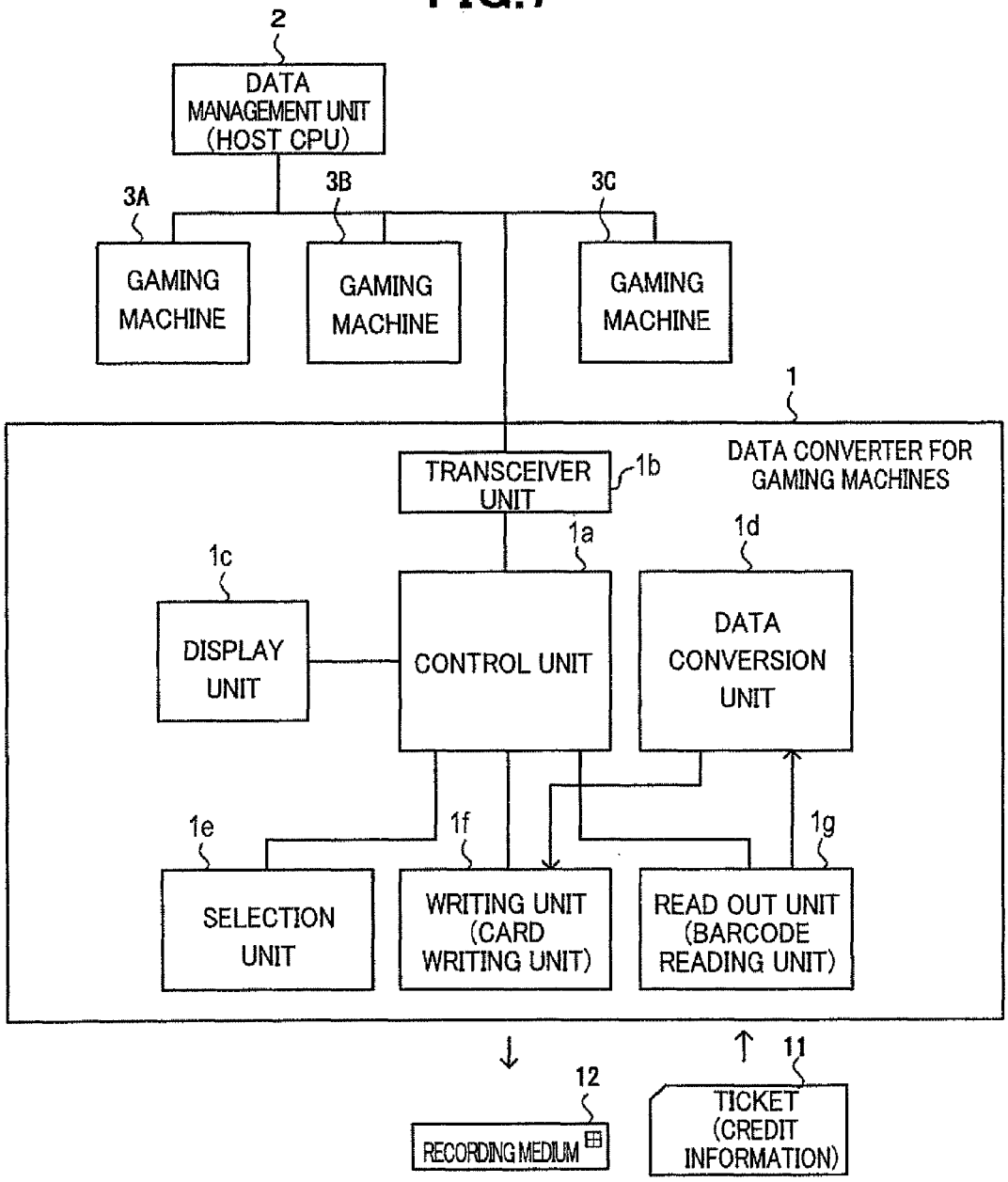
FIG. 7 is a diagram for describing a structural example of the data converter for gaming machines.
Figure 8:
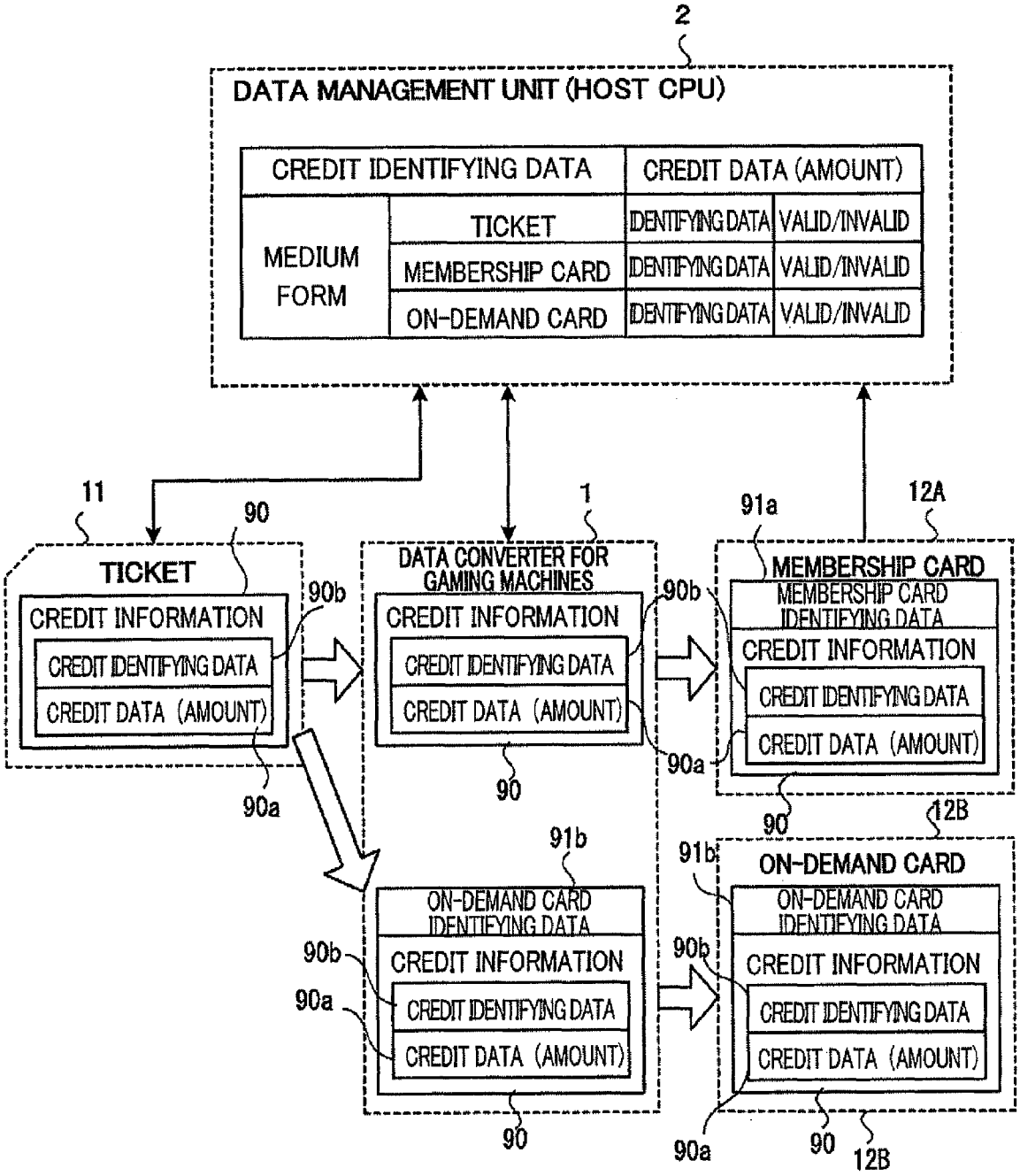
FIG. 8 is a diagram for describing data conversion of the data converter for gaming machines.
Figure 9:
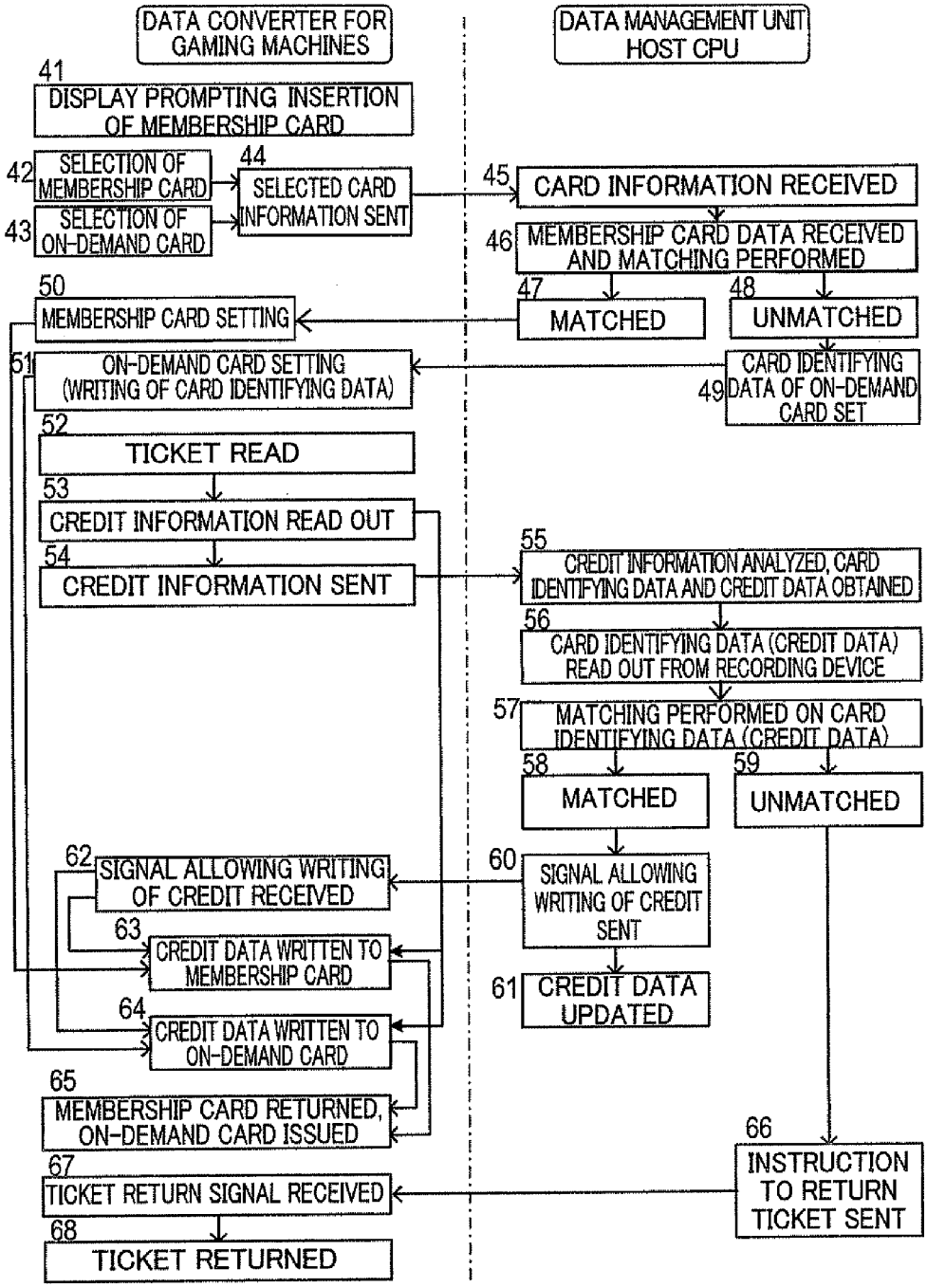
FIG. 9 is a diagram for describing an operation of data conversion of the data converter for gaming machines.
Figure 10:
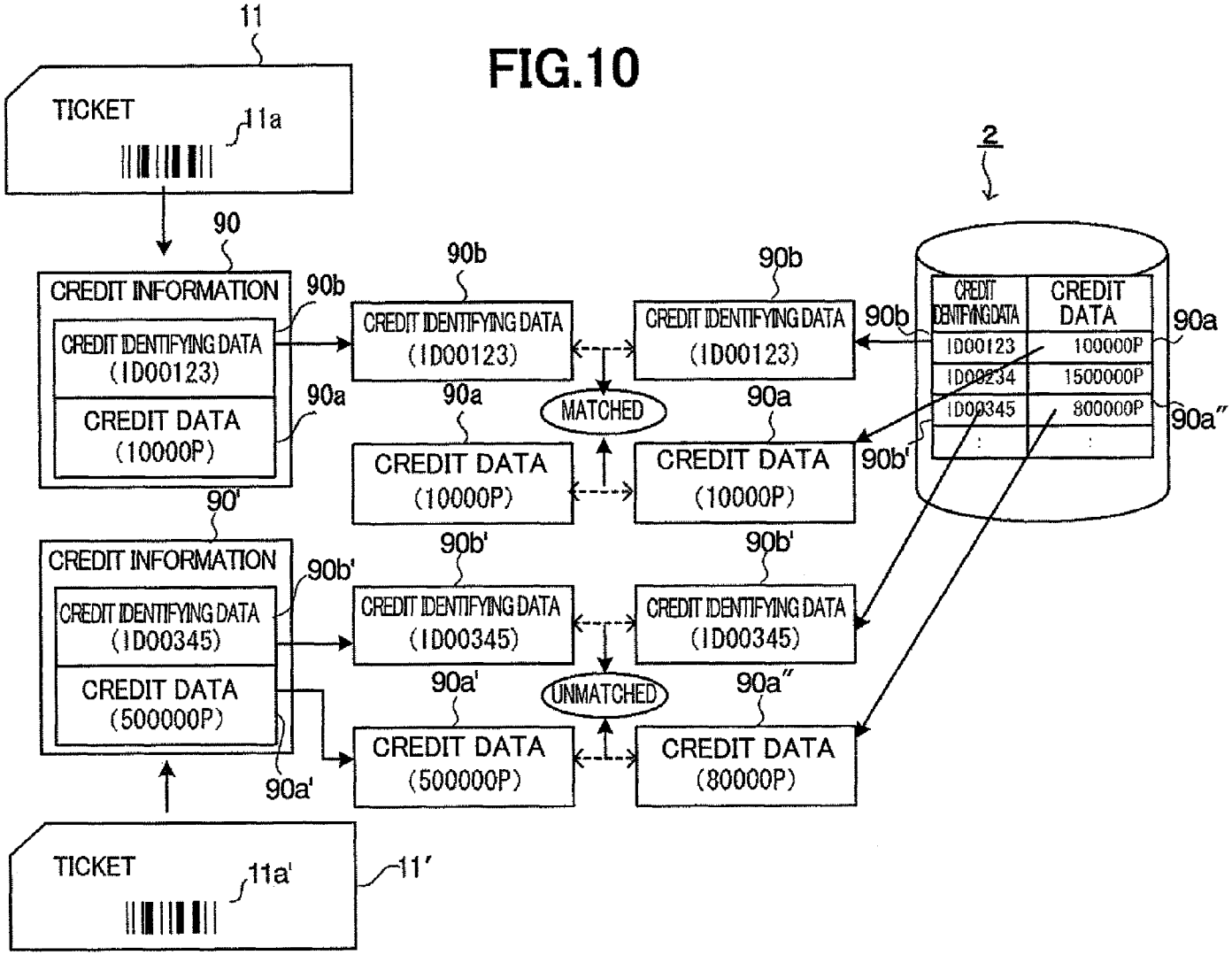
FIG. 10 is a diagram for describing a matching operation at a time of data conversion by the data converter for gaming machines.
Figure 11:
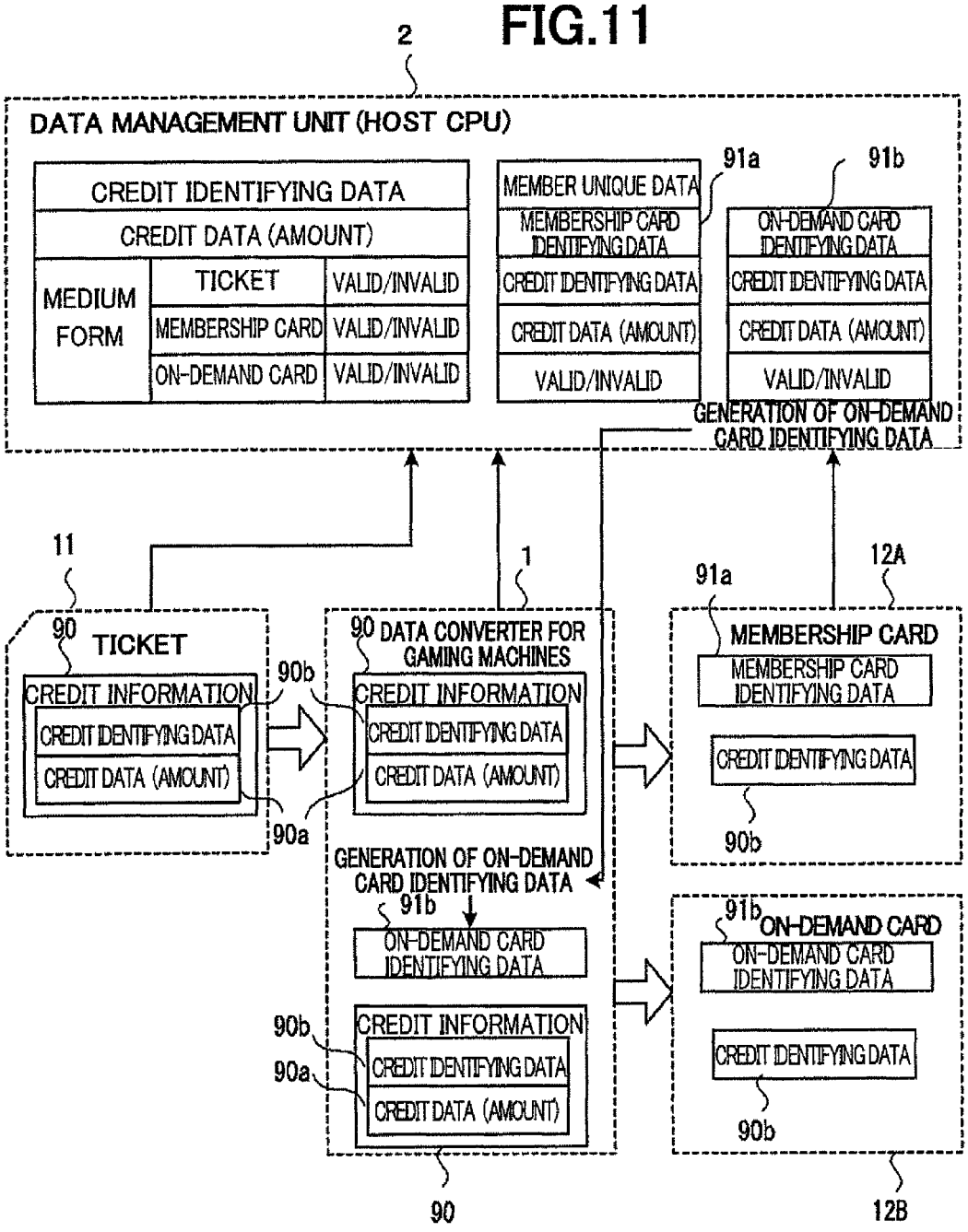
FIG. 11 is a diagram for describing data conversion of the data converter for gaming machines.
Figure 12:
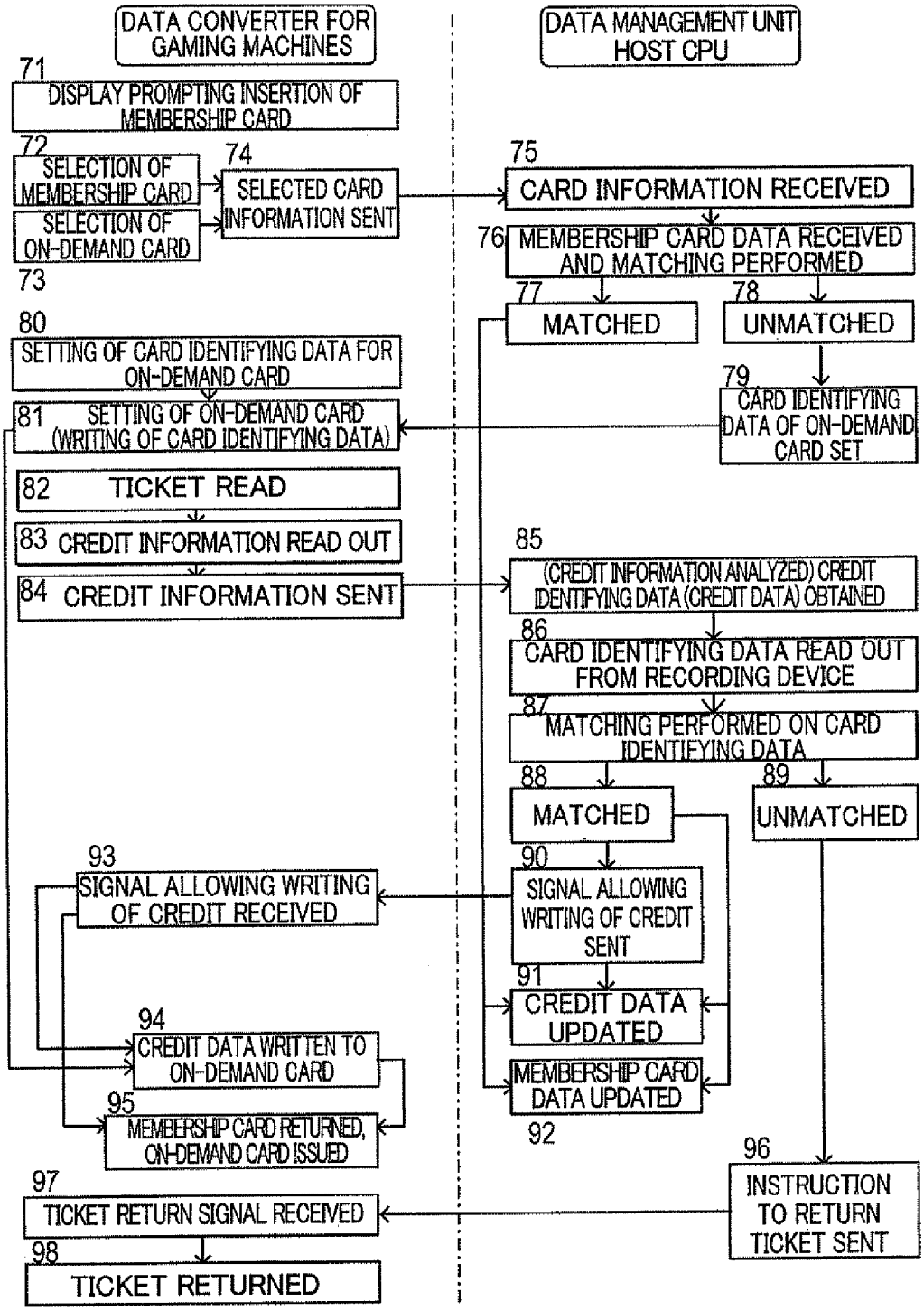
FIG. 12 is a diagram for describing an operation of data conversion of the data converter for gaming machines.

Next, credit information conversion is described using FIGS. 7 to 12. FIG. 7 is a diagram for describing a structural example of the data converter for gaming machines, FIGS. 8 to 10 show structural examples of credit information being recorded to a recording medium after the credit information is converted by the data converter for gaming machines, and FIGS. 11 and 12 show structural examples of credit identifying data being recorded to a recording medium after credit information including credit data is converted by the data converter for gaming machines.

It should be noted that hereinafter the recording medium is described using an example of a card provided with an electronic medium. In FIG. 7, the data converter 1 for gaming machines is provided with a read out unit 1*g* for reading out credit information from the ticket 11, a writing unit 1*f* for carrying out writing of the credit information to the electronic medium mounted in the card, a selection unit 1*e* for selecting types of cards, a data conversion unit 1*d* for performing data conversion on the credit information, which is in a data format such as a barcode that has been read from the ticket 11, to a data format for writing to the electronic medium, a display unit 1*c* for displaying a selection guide of the selection unit 1*e* and other forms of guidance, a transceiver unit 1*b* that carries out sending and receiving of data to and from the data management unit 2, and a control unit 1*a* for controlling these units.

The electronic medium for writing credit information that has undergone data conversion is mounted in a card. In addition to a card in which card identifying data is registered in advance in the manner of a membership card, this card may be a card that is issued when required in the manner of an on-demand card. The data converter for gaming machines can record credit information to both of these membership cards and on-demand cards. The selection unit 1*e* is a portion for selecting to which of these cards converted credit information is to be recorded and, for example, can perform selection according to a selection guide displayed on the display unit 1*c*.

It should be noted that when a card is selected in which card identifying data is registered in advance in the manner of a membership card, the card itself can be specified using the card identifying data that is already registered in the manner of membership card identifying data, but when a card is selected in which card identifying data is not registered in advance such as with an on-demand card, on-demand card identifying data is generated to specify the actual card and credit information is generated by combining the generated on-demand card identifying data and the credit data.

Next, credit information conversion is described.

First, description is given using an example in which credit identifying data and credit data are recorded to the recording medium and the numerical amount of credit on the recording medium is managed. In this example, the numerical amount of credit is processed for each unit of recording media, and therefore even supposing that credit is being used illicitly, that range of illicit usage can be restricted.

In FIG. 8, credit information 90 including credit data 90*a* and credit identifying data 90*b* is recorded in a data format such as a barcode on the ticket 11 that has been issued. The data converter 1 for gaming machines reads the credit information 90 from the ticket 11 and conducts data conversion to a data format that can be recorded on the electronic medium and writes.

Here, when the card in which the electronic medium for carrying out writing is mounted is a membership card 12A, membership card identifying data 91*a* that specifies the card is already set, and therefore in addition to the membership card identifying data 91*a*, credit information 90 that has undergone data conversion is written to the electronic medium.

Furthermore, when the card in which the electronic medium for carrying out writing is mounted is an on-demand card 12B, there has been no on-demand card identifying data 91*b* yet set which specifies that card, and therefore the on-demand card identifying data 91*b* is generated and written to the electronic medium along with the credit information 90 that has undergone data conversion. The on-demand card identifying data 91*b* may be generated inside the data converter 1 for gaming machines or may be generated on the data management unit 2 side. When generated on the data management unit 2 side, the data converter 1 for gaming machines obtains the on-demand card identifying data 91*b* generated from the data management unit 2.

With the credit information written on the electronic medium mounted in the card, the card is specified by using the membership card identifying data 91*a* or the on-demand card identifying data 91*b*, and credit return is carried out by specifying the credit using the credit data 90*a*. In addition to being carried out based on both the credit identifying data and the credit data as described above, the specification of credit may be carried out using only the credit identifying data.

FIG. 9 shows an example of an operational procedure for describing credit conversion processing. Furthermore, FIG. 10 is a diagram for describing a matching process within the credit conversion processing.

The data converter for gaming machines carries out (S41) display of a guide on the display unit prompting insertion of a membership card. In accordance with the guide display, a user selects (S42, S43) a membership card or an on-demand card as the card onto which data-converted credit is to be written, and then sends the card information (S44). The data management unit receives (S45) the card information.

In a case of membership card identifying data being obtained, this is matched against (S46) membership card identifying data stored in the data management unit. If the match is in agreement (S47), credit information that has undergone data conversion is set (S50) so as to be written to the membership card by the data converter for gaming machines.

On the other hand, if the match is not in agreement, or when an on-demand card has been selected (S48), an instruction (S49) is made to the data converter for gaming machines to set the on-demand card. Upon receiving the instruction to set the on-demand card, the data converter for gaming machines sets (S51) the credit information that has undergone data conversion so as to be written to the on-demand card.

Furthermore, the data converter for gaming machines reads (S52) the ticket, reads out (S53) the credit information, and sends (S54) to the data management unit the credit information that has been read out.

The data management unit analyzes the credit information and obtains (S55) credit identifying data and credit data. Furthermore, it reads out (S56) credit identifying data and credit data that has been stored in a recording device, then matches the credit identifying data and credit data obtained from the gaming machine with the credit identifying data and the credit data that has been read out from the recording device.

It should be noted that verification as to whether credit is legitimate or whether there is a possibility of it being illicit is carried out here using a matching process in regard to the credit identifying data and the credit data, but the legitimacy of the credit may be confirmed using only the credit identifying data.

In FIG. 10, the ticket 11 indicates a case of legitimate usage and a ticket 11' indicates a case of illicit usage. Since the ticket 11 is legitimate, the credit identifying data 90*b* and the credit data 90*a* are in agreement when matched against the credit identifying data 90*b* and the credit data 90*a* stored in the data management unit 2.

On the other hand, with the ticket 11', when the credit data has been falsified, credit identifying data 90*b'* will be in agreement with the credit identifying data 90*b'* stored in the data management unit 2, but the credit data 90*a'* will not be in agreement with credit data 90*a"*, and therefore will be determined as unmatched.

It should be noted that here matching is carried out for the two sets of data, the credit identifying data and the credit data, but this may also be configured to be carried out on the credit identifying data only. In this case, matching based on the credit data is not carried out, and therefore falsification of credit data cannot be detected (S57).

When matching has been carried out correctly (S58), a signal allowing writing of credit is sent (S60) to the gaming machine, and when credit data is being managed, the credit data of credit is updated (S61).

Upon receiving (S62) a signal allowing writing of credit, the gaming machine writes (S63, S64) credit data to the membership card or the on-demand card, then carries out (S65) return of the membership card or issuance processing for the on-demand card.

When a determination of being unmatched is made (S59) in the matching process of S57, an instruction to return the ticket is sent (S66) to the gaming machine.

Upon receiving (S67) the instruction to return the ticket, the gaming machine returns (S68) the ticket to the user.

It should be noted that in cases where illicit usage such as theft or falsification are obvious in the matching of credit identifying data for a membership card, a process can be carried out of suspending the return of the membership card.

Next, description is given using an example in which only credit identifying data is recorded to the recording medium and management of the numerical amount of credit is carried out by the data management unit. In this example, the numerical amount of credit is handled comprehensively by the data management unit and therefore it is possible to grasp a history of credit fluctuation for various situations such as the generation of credit accompanying ticket issuance, conversion of credit by the data converter for gaming machines, and the return of (or the consumption of) credit accompanying usage of the gaming machine involving the use of the card.

In FIG. 11, credit information 90 including credit data 90*a* and credit identifying data 90*b* is recorded in a data format such as a barcode on the ticket 11 that has been issued. The data converter 1 for gaming machines reads the credit information 90 from the ticket 11, selects the credit identifying data 90*b* from the credit information 90, and conducts data conversion to a data format that can be recorded on the electronic medium and writes.

Here, when the card in which the electronic medium for carrying out writing is mounted is a membership card 12A, membership card identifying data 91*a* that specifies the card is already set, and therefore in addition to the membership card identifying data 91*a*, the credit identifying data 90*b* that has undergone data conversion is written to the electronic medium.

Furthermore, when the card in which the electronic medium for carrying out writing is mounted is an on-demand card 12B, there has been no on-demand card identifying data 91*b* yet set that specifies that card, and therefore the on-demand card identifying data 91*b* is generated and written to the electronic medium along with the credit identifying data 90*b* that has undergone data conversion. The on-demand card identifying data 91*b* may be generated inside the data converter 1 for gaming machines or may be generated on the data management unit 2 side. When generated on the data management unit 2 side, the data converter 1 for gaming machines obtains the on-demand card identifying data 91*b* generated from the data management unit 2.

With the credit identifying data 90*b* that is written onto the electronic medium mounted on the card, the card is specified and credit return is carried out.

FIG. 12 shows an example of an operational procedure for describing credit conversion processing in a configuration having only data (card or credit) identifying data on the card.

The data converter for gaming machines carries out (S71) display of a guide on the display unit prompting insertion of a membership card. In accordance with the guide display, a user selects (S72, S73) a membership card or an on-demand card as the card onto which data-converted credit is to be written, and then sends (S74) the card information. The data management unit receives (S75) the card information.

In a case of membership card identifying data being obtained, this is matched against (S76) membership card identifying data stored in the data management unit.

If the match is not in agreement, or when an on-demand card has been selected (S78), an instruction (S79) is made to the data converter for gaming machines to set the on-demand card.

The data converter for gaming machines generates (S80) card identifying data of the on-demand card, and the generated on-demand card identifying data is written (S81) to the on-demand card based on the setting instruction for the on-demand card identifying data from the data management unit.

Furthermore, the data converter for gaming machines reads (S82) the ticket, reads out (S83) the credit information, and sends (S84) to the data management unit the credit information that has been read out.

The data management unit analyzes the credit information and obtains (S85) credit identifying data and credit data.

It reads out (S86) credit identifying data that has been stored in a recording device, then matches the credit identifying data obtained from the gaming machine with the credit identifying data that has been read out from the recording device. It should be noted that verification as to whether credit is legitimate or whether there is a possibility of it being illicit is carried out here with a matching process using the credit identifying data, but the legitimacy of the credit may be confirmed using two sets of data, namely the credit identifying data and the credit data.

When matching has been carried out correctly (S88), a signal allowing writing of credit is sent (S90) to the gaming machine, the credit data of the credit is updated (S91), and the data of the membership card is also updated (S92).

Upon receiving (S93) a signal allowing writing of credit, the gaming machine writes credit data to the membership card or the on-demand card, then carries out (S94, S95) return of the membership card or issuance processing for the on-demand card.

When a determination of being unmatched is made (S89) in the matching process of S87, an instruction to return the ticket is sent (S96) to the gaming machine.

Upon receiving (S97) the instruction to return the ticket, the gaming machine returns (S98) the ticket to the user.

It should be noted that in cases where illicit use such as theft or falsification are obvious in the matching of credit identifying data or in the matching of membership cards, a process can be carried out of suspending the return of the ticket or the membership card.

Figure 13:
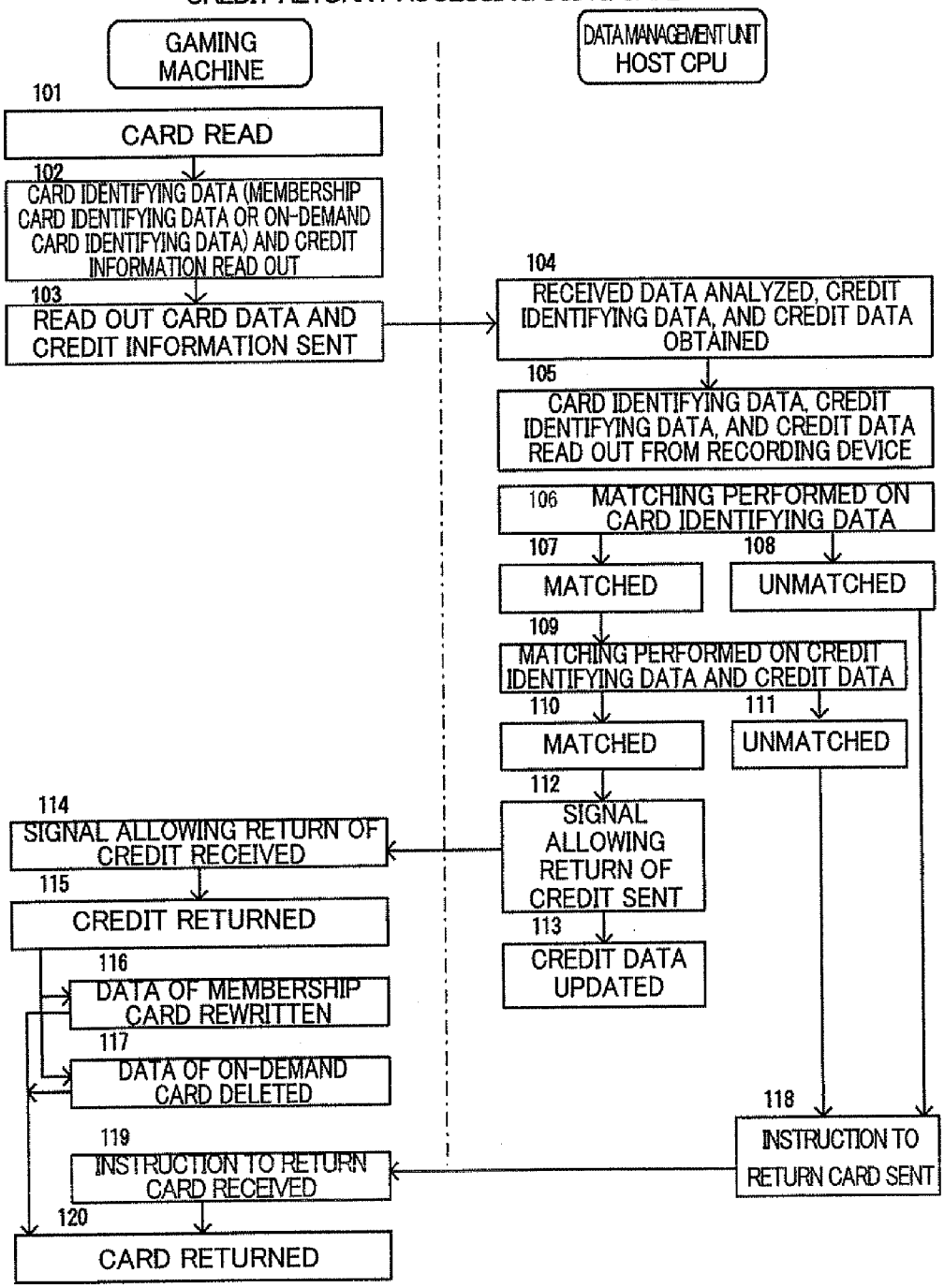
FIG. 13 is a diagram for describing an operation of credit return processing using a card.

A process of returning credit using a card is described using FIG. 13.

In FIG. 13, the gaming machine reads (S101) data recorded on the electronic medium mounted in the card, reads (S102) card identifying data (membership card identifying data or on-demand card identifying data) and credit information, then sends (S103) to the data management unit the card identifying data and credit information that has been read.

The data management unit receives the card identifying data and the credit information, analyzes the credit information, and obtains (S104) credit identifying data and credit data. Furthermore, it reads out (S105) card identifying data, credit identifying data and credit data that has been stored in a recording device, then matches the card identifying data, credit identifying data and credit data obtained from the gaming machine with the card identifying data, credit identifying data and credit data read out from the recording device.

It should be noted that in the matching, matching of the actual card is carried out (S106) using the card identifying data, and matching of the credit is carried out (S109) using the credit information. In addition to the matching process being carried out based on the two sets of data being the credit identifying data and the credit data, the matching of credit in S109 may be carried out using only the credit identifying data.

When a determination is made that there is a legitimate card (S107) in the matching of the card in S106 and moreover when a determination is made that there is legitimate credit (S110) in the matching of credit in S109, a signal allowing return of credit is sent (S112) to the gaming machine, and when credit data is being managed by the data management unit, the credit data of returned credit is updated (S113).

Upon receiving (S114) the signal allowing return of credit, the gaming machine returns the credit (S115). Return of credit can be carried out by executing the gaming machine equivalent to a credit amount determined by the credit data for example. In addition to being collected on the gaming machine side, a card whose credit has been returned may undergo (S116, S117) processing for return completion, after which it may be returned (S120) to the user. It should be noted that the returning of credit is not limited to execution on the gaming machine but may be performed by a different process.

After the credit has been returned, the credit data for the membership card is rewritten (S116), and for on-demand cards, the credit data is eliminated (S117) and the card returned (S120).

When a determination of being unmatched is made (S108) in the card matching process in S106 and when a determination of being unmatched is made in the credit matching process in S109 (S111), an instruction to return the card is sent (S118) to the gaming machine.

Upon receiving (S119) the instruction to return the card, the gaming machine returns (S120) the card to the user.

Furthermore, in cases where illicit usage such as theft or falsification are obvious in the matching of credit identifying data, a process of collecting the card as it is can be carried out without returning it.

Figure 14:
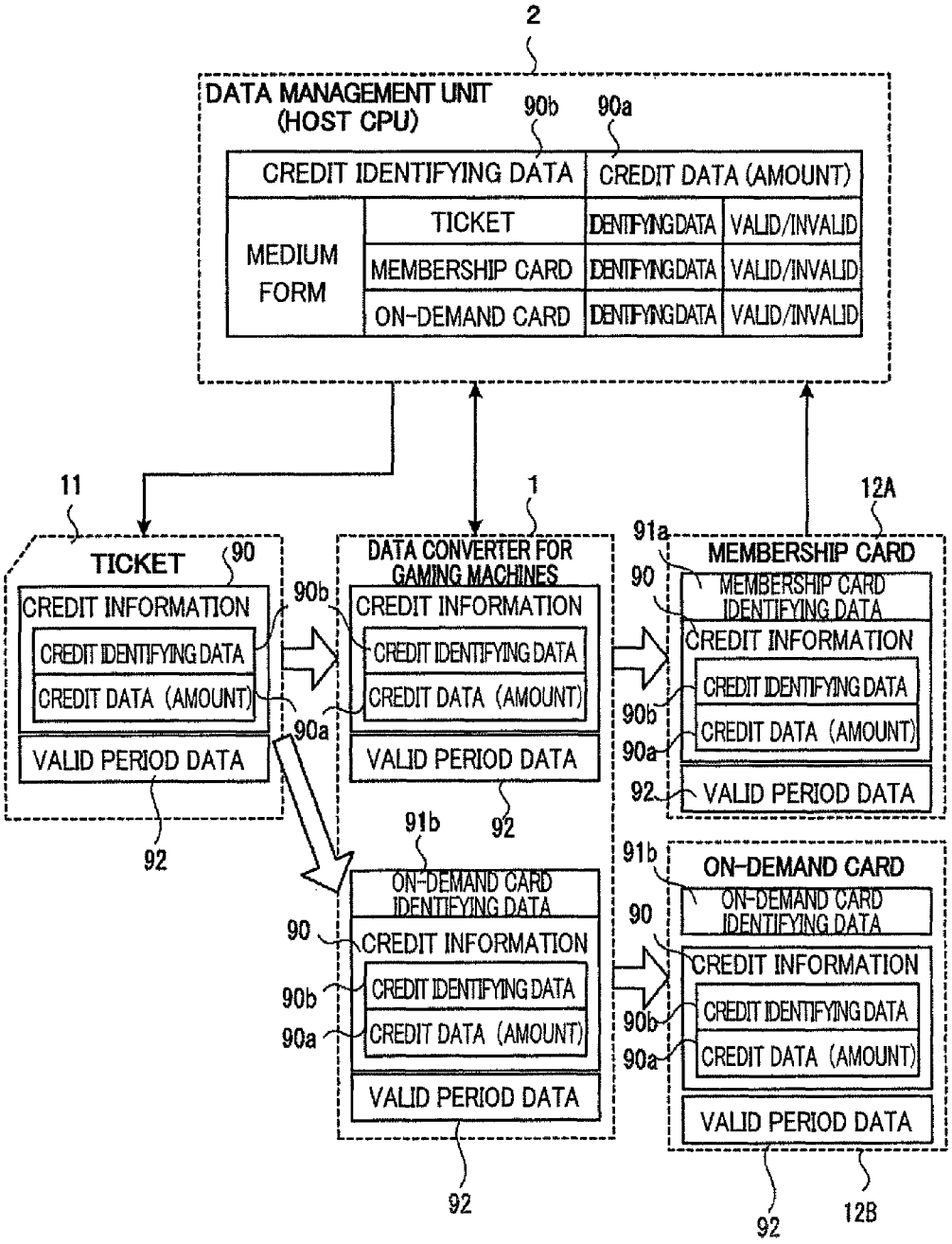
FIG. 14 is a diagram for describing data conversion of credit in which a valid period has been set.

With the data converter for gaming machines of the present invention, a valid period can be set for credit. FIG. 14 describes an operation of the data converter for gaming machines when a valid period is set for credit. It should be noted that FIG. 14 shows an example in which the valid period of credit is recorded in the electronic medium mounted in the card.

In addition to being setting at a ticket stage, the valid period may be set at a stage of data conversion by the data converter for gaming machines. In FIG. 14, valid periods are set for both stages, but this may also be a form in which one or the other is set or where the valid period set at the ticket stage is set and updated by the data converter for gaming machines.

In FIG. 14, credit information 90 including credit data 90*a* and credit identifying data 90*b* is recorded in a data format such as a barcode on the ticket 11 that has been issued. Furthermore, valid period data 92 may be set in the ticket 11.

The data converter 1 for gaming machines reads the credit information 90 from the ticket 11, selects the credit identifying data 90*b* or the credit date 90*a* from the credit information 90, and conducts data conversion to a data format that can be recorded on the electronic medium and writes.

Furthermore, when the valid period data 92 is set, in addition to conducting data conversion and writing the valid period data 92 to the electronic medium mounted in the card, the valid period may be newly set and the valid period data 92 of a valid period different from the valid period set in the ticket 11 may be set.

Here, when the card in which the electronic medium for carrying out writing is mounted is a membership card 12A, membership card identifying data 91*a* that specifies the card is already set, and therefore in addition to the membership card identifying data 91*a*, the credit identifying data 90*b* or the credit data 90*a* which has undergone data conversion is written to the electronic medium.

Furthermore, when the card in which the electronic medium for carrying out writing is mounted is an on-demand card 12B, there has been no on-demand card identifying data 91*b* yet set that specifies that card, and therefore the on-demand card identifying data 91*b* is generated and written to the electronic medium along with the credit identifying data 90*b* that has undergone data conversion. The on-demand card identifying data 91*b* may be generated inside the data converter 1 for gaming machines or may be generated on the data management unit 2 side. When generated on the data management unit 2 side, the data converter 1 for gaming machines obtains the on-demand card identifying data 91*b* generated from the data management unit 2.

The data management unit or the gaming machine reads out the valid period data 92 recorded on the card and determines whether the credit information is valid or invalid based on the valid period.

Figure 15:
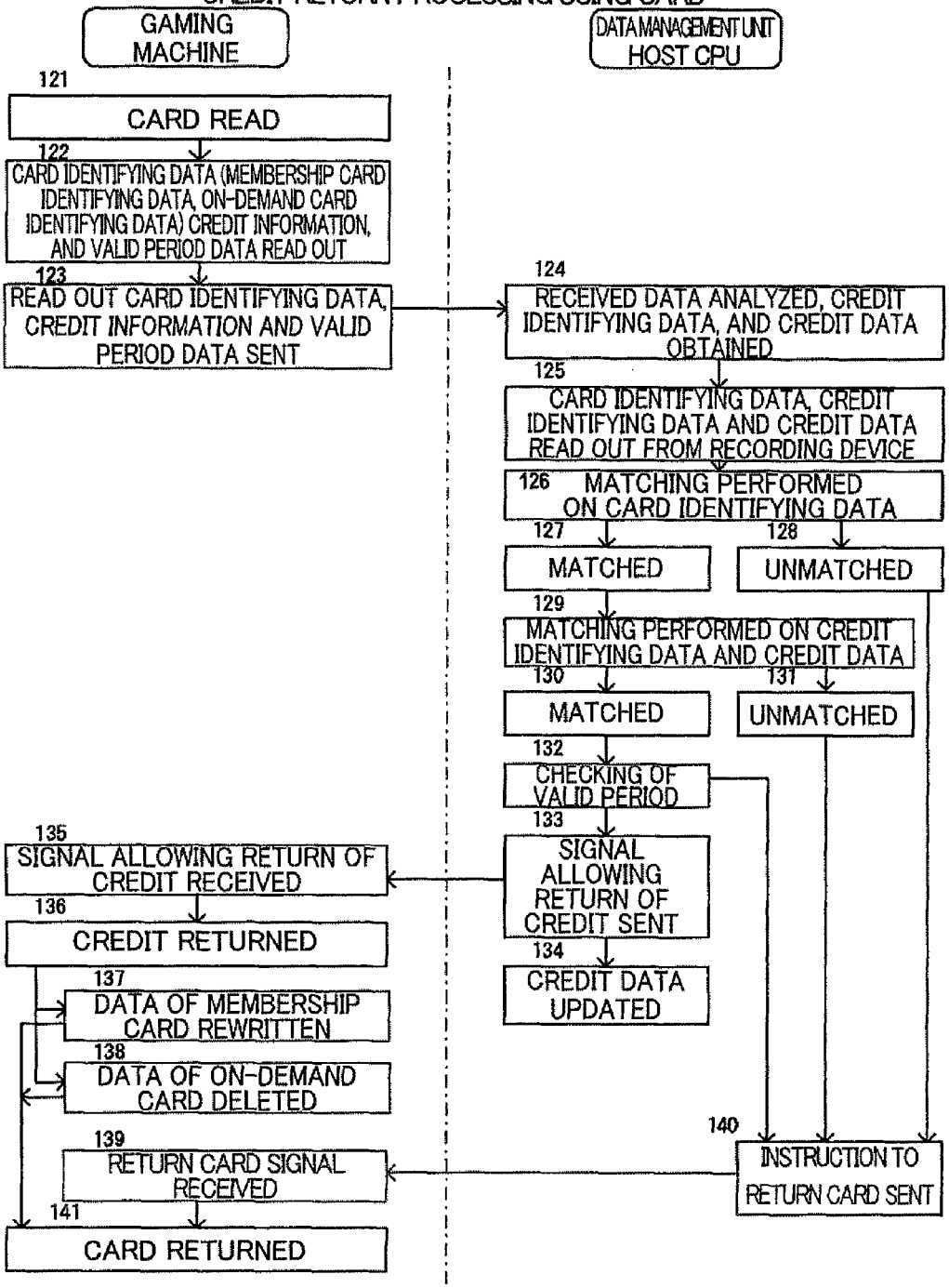
FIG. 15 is a diagram for describing an operation of credit return processing in which a valid period has been set.

An operational example of a credit return processing when a valid period is set in the card is described using FIG. 15.

In FIG. 15, the gaming machine reads (S121) data recorded on the electronic medium mounted in the card, reads (S122) card identifying data (membership card identifying data or on-demand card identifying data), credit information, and valid period data, then sends (S123) to the data management unit the card identifying data, credit information, and valid period data that has been read.

The data management unit receives the card identifying data, the credit information, and the valid period data and analyzes the credit information, then obtains (S124) credit identifying data and credit data. Furthermore, it reads out (S125) card identifying data, credit identifying data, and credit data, which have been stored in a recording device, then matches the card identifying data, credit identifying data and credit data obtained from the gaming machine with the card identifying data, credit identifying data and credit data read out from the recording device.

It should be noted that in the matching, matching of the actual card is carried out (S126) using the card identifying data, and matching of the credit is carried out (S129) using the credit information. In addition to the matching process being carried out based on the two sets of data being the credit identifying data and the credit data, the matching of credit in S129 may be carried out for only the credit identifying data.

When a determination is made that there is a legitimate card (S127) in the matching of the card in S126 and moreover when a determination is made that there is legitimate credit (S130) in the matching of credit in S129 and when the valid period is confirmed (S132) and it is within the valid period, a signal allowing return of credit is sent (S133) to the gaming machine, and when credit data is being managed, the credit data of returned credit is updated (S134).

Upon receiving (S135) a signal allowing return of credit, the gaming machine returns credit (S136).

After the credit has been returned, the credit data for the membership card is rewritten (S137), and for on-demand cards, the credit data is eliminated (S138) and the card returned (S141).

When a determination of being unmatched is made (S128) in the card matching process in S126 and when a determination of being unmatched is made (S131) in the credit matching process in S129, an instruction to return the card is sent (S140) to the gaming machine.

Upon receiving (S139) the instruction to return the card, the gaming machine returns (S141) the card to the user.

Furthermore, in cases where illicit usage such as theft or falsification are obvious in the matching of credit identifying data and card identifying data, a process of collecting the card as it is can be carried out without returning it.

The data converter for gaming machines shown in FIG. 7 is for carrying out data conversion of credit information that has been recorded on a ticket to a card, but the data converter for gaming machines of the present invention may be configured to be provided with a function for carrying out data conversion of credit information that has been recorded on a card to a ticket.

Figure 16:
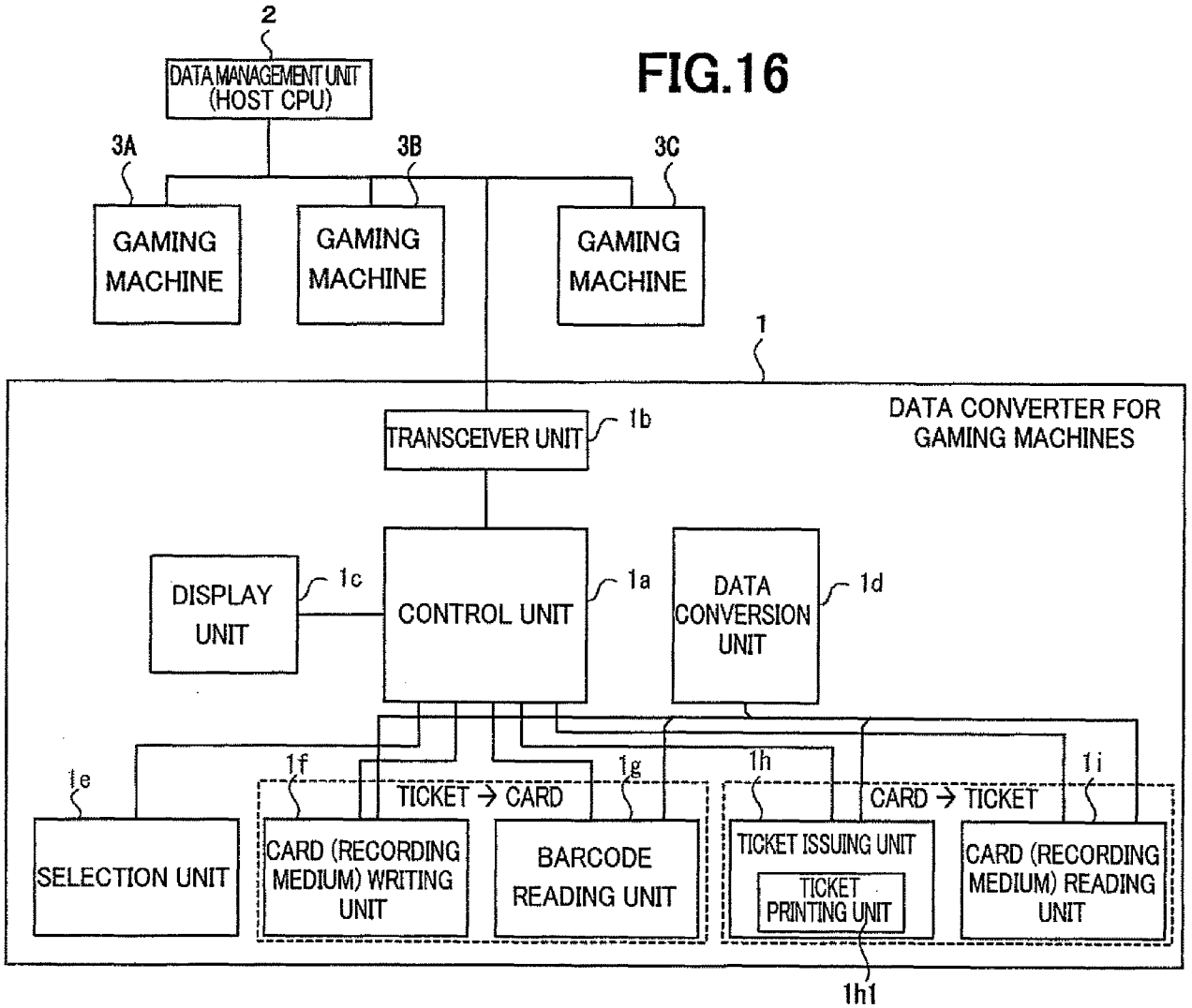
FIG. 16 is a diagram for describing a structural example provided with two functions, a function of carrying out data conversion from a ticket to a card and a function of carrying out data conversion from a card to a ticket.
Figure 17A:
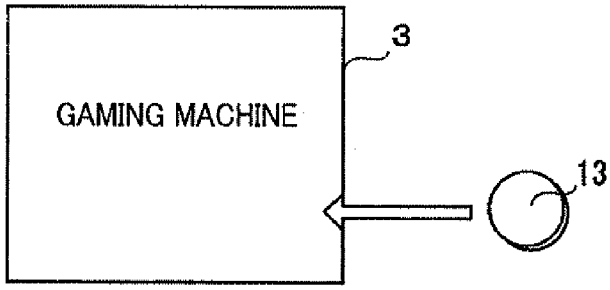
FIGS. 17A to 17C are diagrams for describing a gaming machine that uses tickets.
Figure 17B:
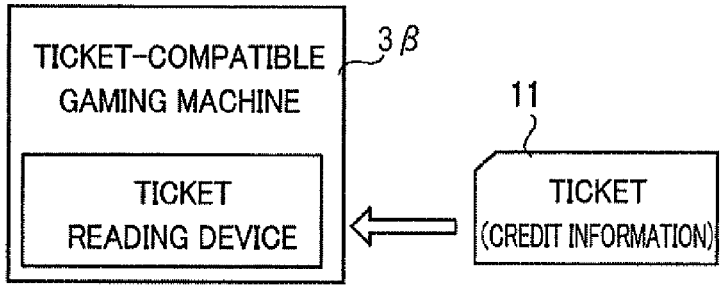
Figure 17C:
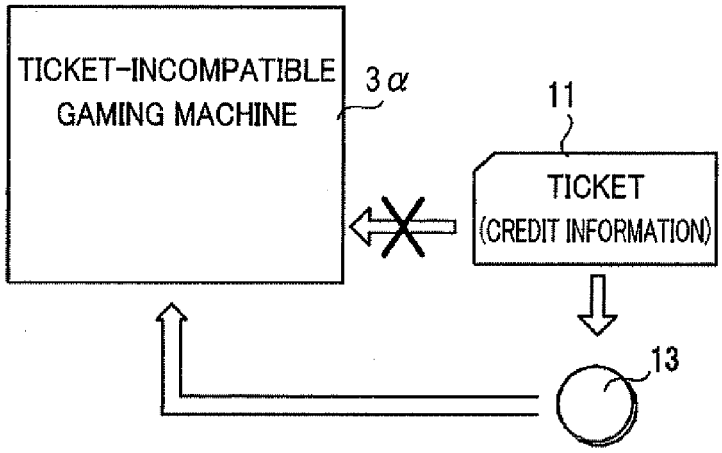

FIG. 16 shows a structural example provided with two functions, a function of carrying out data conversion from a ticket to a card and a function of carrying out data conversion from a card to a ticket. In addition to the structure shown in the structure of FIG. 7, the structural example shown in FIG. 16 is provided with a ticket issuing unit 1*h* and a card (recording medium) reading unit 1*i* as a structure for carrying out data conversion from the card to the ticket.

The card (recording medium) reading unit 1*i* reads out credit information and card identifying data and the like recorded on the electronic medium mounted in the card and after performing data conversion, prints a barcode or the like on a ticket surface using a ticket printing unit 1*h*1 provided in the ticket issuing unit 1*h*.

The data conversion can be achieved in a same manner as the case for conversion from ticket to card and therefore detailed description is omitted.

It should be noted that the data converter for gaming machines and credit management system of the present invention can be applied to every kind of gaming machine installed in game arcades.

What is claimed is:

1. A credit management and fraud detection system for a game arcade, the system comprising:

a first gaming machine utilizing printed tickets on which game machine credit information, for purchasing a game on the first gaming machine, is printed, the first gaming machine including a first reader/writer that reads game machine credit information printed on the printed tickets, the game machine credit information including credit identifying data that specifies a credit set and credit data that represents value of each credit within each credit set, and writes game machine credit information on one of the printed tickets, and not including a reader/writer that reads and writes game machine credit information stored in an electronic medium from and to an electronic storage medium;

a second gaming machine utilizing electronic recording media, in which game machine credit information, for purchasing a game on the second gaming machine, is stored, the second gaming machine including a second reader/writer that reads the game machine credit information recorded in the electronic recording media, and writes the game machine credit information into the electronic recording media, and not including a reader/writer that reads and writes game machine credit information printed on a ticket from and to a printed ticket;

a data converter, separate from the first and second gaming machines, for converting the game machine credit information printed on the printed tickets into a data format for storing in one of the electronic recording media and for converting the game machine credit information read from the electronic recording media into a data format for printing on one of the printed tickets;

a data management unit including an electronic memory that stores and manages the game credit information; and a network connecting the first gaming machine, the second gaming machine, the data converter, and the data management unit for transmission of the game machine credit information read by the first and second reader/writers to the data management unit for comparison, in the data management unit, to game machine credit information stored in the memory of the data management unit, wherein when either of the first and second reader/writers writes game machine credit information on a printed ticket or in an electronic recording medium, the game machine credit information written is transmitted through the network to and stored in the memory of the data management unit as first validation information, and when the data converting unit receives the machine credit information from either of the first and second reader/writers for converting between data formats for storing in one of the electronic recording media or for printing on one of the printed tickets, the data converter sends, through the network, the game machine credit information received, as second validation information, to the data management unit where the credit identifying data and the credit data of the second validation information are compared to stored first validation information and, (i) if the first and second validation information agree, the data management unit enables the data converter to make a data conversion and, (ii) if the first and second validation information do not agree, the printed ticket or electronic storage medium is returned without a data conversion.

2. The credit management and fraud detection system according to claim 1, wherein the electronic recording medium into which the second reader/writer writes the game machine credit information is mounted in a card and card identifying data that identifies the card is stored in the electronic recording medium.

3. The credit management and fraud detection system according to claim 1, wherein the game machine credit information printed on the printed tickets is recorded as a barcode.

4. The credit management and fraud detection system according to claim 3, wherein the first reader/writer comprises a barcode reader.

5. The credit management and fraud detection system according to claim 1, wherein the data converter sends the credit identifying data to the data management unit during conversion of the game machine credit information, and the data management unit manages conversion of the credit set in response to the credit identifying data received from the data converter.

6. The credit management and fraud detection system according to claim 1, wherein the data converter sends the game machine credit information to the data management unit during conversion of the game machine credit information, and the data management unit manages conversion of the credit set and the credit data that has undergone data conversion in response to the game machine credit information received from the data converter.

7. The credit management and fraud detection system according to claim 1, wherein the electronic recording medium into which the second reader/writer writes the game machine credit information is mounted in a card and no card identifying data that identifies the card is stored in the electronic recording medium.

8. The credit management and fraud detection system according to claim 1, wherein the electronic recording medium into which the second reader/writer writes the game machine credit information is mounted in a card and the second reader/writer writes the credit identifying data and card identifying data, identifying the card, into the electronic recording medium.

9. The credit management and fraud detection system according to claim 8, wherein the second reader/writer generates the card identifying data that is stored in the electronic recording medium.

10. The credit management and fraud detection system according to claim 1, wherein the credit identifying data includes time limit data that determines a valid period of the credit identifying data, and the data converting unit sets the time limit data upon conversion of the game machine credit information to a data format suitable for storing in one of the printed tickets or one of the electronic recording media.

11. The credit management and fraud detection system according to claim 10, wherein the time limit data includes at least one of time data representing a finish time at which validity ends, time data representing a start time and the finish time of the validity, time data representing the start time of the validity, and time duration data representing a time duration of the validity.

12. The credit management and fraud detection system according to claim 1, wherein the network includes cables connecting the first and second gaming machines, the data converter, and the data management unit.

13. The credit management and fraud detection system according to claim 1, wherein the network is a wireless network connecting the first and second gaming machines, the data converter, and the data management unit.

14. A method of credit management and fraud detection for a game arcade including a first gaming machine utilizing printed tickets on which game machine credit information, for purchasing a game on the first gaming machine, is printed, and a second gaming machine utilizing electronic recording media, in which game machine credit information, for purchasing a game on the second gaming machine, is stored, the first gaming machine including a first reader/writer that reads game machine credit information printed on the printed tickets, the game machine credit information including credit identifying data that specifies a credit set and credit data that represents value of each credit within each credit set, and writes game machine credit information on one of the printed tickets, and not including a reader/writer that reads and writes game machine credit information stored in an electronic medium from and to an electronic storage medium, and the second gaming machine including a second reader/writer that reads the game machine credit information recorded in the electronic recording media, and writes the game machine credit information into the electronic recording media, and not including a reader/writer that reads and writes game machine credit information printed on a ticket from and to a printed ticket, the method comprising:

converting the game machine credit information printed on the printed tickets into a data format for storing in one of the electronic recording media and converting the game machine credit information read from the electronic recording media into a data format for printing on one of the printed tickets;

storing in a memory and managing the game credit information communicated to and from the first and second gaming machines, wherein when either of the first and second reader/writers writes game machine credit information on a printed ticket or in an electronic recording medium, the game machine credit information written is transmitted to and stored in the memory as first validation information, and when the machine credit information is received from either of the first and second reader/writers for converting between data formats for storing in one of the electronic recording media or for printing on one of the printed tickets, comparing the credit identifying data and the credit data of the game machine credit information received, as second validation information, to the first validation information stored in the memory and, (i) if the first and second validation information agree, enabling a data conversion and, (ii)

if the first and second validation information do not agree, returning the printed ticket or electronic storage medium without a data conversion.

15. The credit management and fraud detection method according to claim 14, including printing the game machine credit information on the printed tickets as a barcode.

16. The credit management and fraud detection method according to claim 14, wherein the credit identifying data includes time limit data that determines a valid period of the credit identifying data, and including setting the time limit data upon conversion of the game machine credit information to a data format suitable for storing in one of the printed tickets or one of the electronic recording media.

17. The credit management and fraud detection method according to claim 14, wherein the credit identifying data includes time limit data that determines a valid period for the credit identifying data, and the time limit data includes at least one of time data representing a finish time at which validity ends, time data representing a start time and the finish time of the validity, time data representing the start time of the validity, and time duration data representing a time duration of the validity.

18. The credit management and fraud detection method according to claim 14, including sending the credit identifying data to the memory during conversion of the game machine credit information, and converting the credit set in response to the credit identifying data received.

19. The credit management and fraud detection method according to claim 14, including sending the game machine credit information to the memory during conversion of the game machine credit information, and converting the credit set and the credit data that has undergone data conversion in response to the game machine credit information received.

20. The credit management and fraud detection method according to claim 14, wherein the electronic recording medium into which the second reader/writer writes the game machine credit information is mounted in a card and including not writing any card identifying data that identifies the card in the electronic recording medium.

21. The credit management and fraud detection method according to claim 14, wherein the electronic recording medium into which the second reader/writer writes the game machine credit information is mounted in a card and including writing the credit identifying data and card identifying data, identifying the card, into the electronic recording medium.

* * * * *